US007848665B2

(12) United States Patent
Mutoh

(10) Patent No.: US 7,848,665 B2
(45) Date of Patent: Dec. 7, 2010

(54) IMAGE FORMING APPARATUS, IMAGE FORMING METHOD, IMAGE FORMING COMPUTER PROGRAM, AND COMPUTER READABLE STORAGE MEDIUM CONTAINING THE PROGRAM

(75) Inventor: Yoshinori Mutoh, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 148 days.

(21) Appl. No.: 12/226,425

(22) PCT Filed: Apr. 16, 2007

(86) PCT No.: PCT/JP2007/058247

§ 371 (c)(1),
(2), (4) Date: Oct. 17, 2008

(87) PCT Pub. No.: WO2007/123075

PCT Pub. Date: Nov. 1, 2007

(65) Prior Publication Data

US 2009/0169229 A1 Jul. 2, 2009

(30) Foreign Application Priority Data

Apr. 20, 2006 (JP) ..... 2006-117170

(51) Int. Cl.
*G03G 15/08* (2006.01)

(52) U.S. Cl. ..... 399/27; 399/29; 399/119

(58) Field of Classification Search ..... 399/9, 399/24, 27–29, 54, 55, 107, 110, 111, 119, 399/120

See application file for complete search history.

(56) References Cited

U.S. PATENT DOCUMENTS

| | | | | |
|---|---|---|---|---|
| 4,391,891 | A * | 7/1983 | Tamura et al. | 430/122.51 |
| 5,499,082 | A | 3/1996 | Watanabe et al. | |
| 5,913,094 | A | 6/1999 | Endo | |
| 5,926,677 | A * | 7/1999 | Ochiai et al. | 399/277 |
| 6,519,422 | B1 * | 2/2003 | Takeda et al. | 399/12 |
| 7,418,215 | B2 * | 8/2008 | Ide | 399/27 |
| 2006/0002722 | A1 | 1/2006 | Murata | |

FOREIGN PATENT DOCUMENTS

JP 53-29725 3/1978

(Continued)

OTHER PUBLICATIONS

International Search Report for PCT/JP2007/058247 mailed July 17, 2007.

(Continued)

*Primary Examiner*—Hoan Tran
(74) *Attorney, Agent, or Firm*—Nixon & Vanderhye, PC

(57) ABSTRACT

The image forming apparatus include: a resistance detection section (14) for measuring a volume resistivity of a two component developer (11) on a surface of a developer bearing member (12); a resistance memory section (16) for storing therein a preset volume resistivity; a resistance comparison section (15) for comparing the volume resistivity of the two component developer (11) which has been measured by the resistance detection section (14) with the preset volume resistivity stored in the resistance memory section (16); and a control section (17) for carrying out a process for replacing the two component developer or carrier if the volume resistivity of the two component developer (11) is lower than the preset volume resistivity.

24 Claims, 14 Drawing Sheets

FOREIGN PATENT DOCUMENTS

| | | | |
|---|---|---|---|
| JP | 53-29725 | A | 3/1978 |
| JP | 62-19884 | | 1/1987 |
| JP | 4-34573 | A | 2/1992 |
| JP | 4-80777 | A | 3/1992 |
| JP | 04-329564 | | 11/1992 |
| JP | 4-329564 | A | 11/1992 |
| JP | 06-67484 | | 3/1994 |
| JP | 6-67484 | A | 3/1994 |
| JP | 06-130818 | | 5/1994 |
| JP | 6-130818 | A | 5/1994 |
| JP | 07-110623 | | 4/1995 |
| JP | 10-326047 | A | 12/1998 |
| JP | 2000-98730 | A | 4/2000 |
| JP | 2001-125349 | | 5/2001 |
| JP | 2001-125349 | A | 5/2001 |
| JP | 2002-116625 | A | 4/2002 |
| JP | 2006-18268 | | 1/2006 |

OTHER PUBLICATIONS

English translation of the International Search Report mailed July 17, 2007 in corresponding JP PCT application PCT/JP2007/058247.

* cited by examiner (a)

(b)

IMAGE FORMING APPARATUS, IMAGE FORMING METHOD, IMAGE FORMING COMPUTER PROGRAM, AND COMPUTER READABLE STORAGE MEDIUM CONTAINING THE PROGRAM

This application is the U.S. national phase of International Application No. PCT/JP2007/058247, filed 16 Apr. 2007, which designated the U.S. and claims priority to Japanese Patent Application No. 2006-117170, filed 20 Apr. 2006, the entire contents of each of which are hereby incorporated by reference.

TECHNICAL FIELD

The present technology relates to image forming apparatus which incorporate electrophotography technology whereby an electrostatic latent image formed on an image bearing member is developed and visualized by toner in a two component developer attracted onto a developer bearing member.

BACKGROUND ART

Conventional developers used for development/visualization of an electrostatic latent image formed on an image bearing member in laser printers, copying machines, and like image output devices which embodies electrophotography technology are either a two component developer consisting of toner and carrier or a unary developer consisting only of toner. Magnetic brush development using such a two component developer produces superior image quality to other development methods and are also applicable in color imaging and relatively inexpensive. For these reasons, the development method has been in popular use.

An image forming apparatus embodying the conventional magnetic brush development includes a developer bearing member equipped with a cylindrical metal sleeve and a magnetic roller located inside the sleeve. The roller includes a permanent magnet (magnetic field generation means) in which an N pole and an S pole are provided alternately. By attracting the two component developer to the surface of the metal sleeve of the developer bearing member and rotating only the magnetic roller while fixing the metal sleeve, the two component developer can be transported to a developing area located opposite an image bearing member carrying an electrostatic latent image formed thereon. A development electric field acting between the developer bearing member and the image bearing member causes only charged toner to electrostatically adhere to the image bearing member, thereby forming a visible image.

A shortcoming of the image forming apparatus embodying the conventional magnetic brush development is so-called beads carry over. The term refers to a phenomenon in which the development electric field causes not only toner, but also carrier, to adhere to the image bearing member. The carrier adhesion results in a serious problem of defective images. Specifically, the carrier adhesion is a cause for white spots in image regions and smears in non-image regions. The latter defect is caused by the toner transported on the "adhering carrier" from the developer bearing member. The problem is becoming increasingly serious in recent years because the diameter of toner particles is progressively reduced in response to demand for high image quality and so is the diameter of the carrier particles in line with the toner diameter reduction. The magnetic binding force exerted by the carrier on the developer bearing member weakens with the decreasing carrier particle diameter. The need for a solution to beads carry over problems is increasing.

Beads carry over is governed by various control factors (e.g., magnetic properties of the carrier, the magnetic flux density from the magnetic roller, the diameter of carrier particles, and the electric resistance of the developer), and for the purpose of relieving it, allows for a relatively high degree of freedom in design. Meanwhile, a carrier particle is a semiconducting particle (core) having its surface covered with an insulate resin layer. The resin layer peels off due to external stress over time, and resistance decreases. As a result, carrier may be charged due to an external electric field and a so-called induced charging may occur. That makes carrier adhering more likely to happen. As discussed above, beads carry over is likely to increase due to changes of the resin coating layer of the carrier over time. A solution is needed not only to initial settings, but also to changes over time.

The induced charging will be described below in reference to FIGS. 16(*a*) and 16(*b*). As illustrated in FIG. 16(*a*), a two component developer 11 consisting of a carrier (magnetic carrier) 160 and a toner 161 forms a magnetic brush on the surface of a metal sleeve of a developer bearing member 12 in a developing area and in contact with an image bearing member 21. The carrier 12 has a magnetic roller (not shown) inside thereof. The area in which the magnetic brush contacts the image bearing member 21 and the toner 161 is transported from the developer bearing member 12 to the electrostatic latent image formed on the image bearing member 21 is termed the development nip section.

In this circumstances, if the DC bias voltage applied to the metal sleeve is −400 V and the metal body of the image bearing member 21 is grounded as illustrated in FIG. 16(*a*), the electric charge of the surface of the image bearing member 21 is cancelled in image areas. The surface electrical potential is therefore 0 V in those sections. Negative induced electric charge is thus injected from the development sleeve side to the carrier 160 on or near the tip of the magnetic brush due to an electric field generated in the development nip section. Due to the induced charge, a Coulomb force acts on the carrier 160 on or near the tip of the magnetic brush in the direction toward the image bearing member 21. If the Coulomb force is greater than the magnetic binding force acting on the developer bearing member 12, the carrier is adhered (transferred) to the image bearing member 21 (beads carry over), producing white spot image.

Meanwhile, in non-image areas, negative charge on the surface of the image bearing member 21 is remaining as illustrated in FIG. 16(*b*). If the surface electrical potential is −600 V, positive induced charge is injected from the metal sleeve side to the carrier 160 on or near the tip of the magnetic brush due to an electric field generated in the development nip section. Due to this induced charge, similarly to the caser for the image area, a Coulomb force acts on the carrier 160 on or near the tip of the magnetic brush in the direction toward the image bearing member 21. If the Coulomb force is greater than the magnetic binding force acting on the developer bearing member 12, the carrier is adhered to the image bearing member 21 (beads carry over) and carries the toner 161 with it, producing smears.

The problems of temporally decreasing carrier resistance, as well as resultant increasing beads carry over and deteriorating image formation quality, all detailed above disrupt stable high output image quality over an extended period of time. Various attempts have been made so far to solve the problems.

An example is disclosed in patent document 1. The image forming apparatus detects beads carry over or measures adhering carrier on the basis of the current flow through developer to regulate bias voltages for the image bearing member and the development device according to the detection/measurement. Generally, carrier is likely to adhere when the developer has a low volume resistivity, and the carrier adheres in increasing amounts when a bias voltage is increased in development. These particular issues are addressed by the image forming apparatus which decreases the bias voltage to cancel out the increase of beads carry over caused by decreasing volume resistivity of the developer. Adhering carrier is thus reduced.

Patent document 2 disclosed an image forming apparatus restrains increase of beads carry over by varying the AC duty ratio of a development bias. Specifically, the image forming apparatus includes a power supply in which a DC power supply and an AC power supply are connected in series. Current supply from the power supply to the developer is measured. The volume resistivity of the developer is calculated from the current measurement. A toner mix ratio is predicted from the relationship between the calculated volume resistivity, a predetermined volume resistivity, and a predetermined toner mix ratio. If the predicted toner mix ratio is below a preset tolerable minimum value, the AC duty ratio of the development bias is lowered. The operation reduces the electrical potential difference between the carrier and the latent image region on the image bearing member. This makes it difficult to inject more electric charge from the development electric field to the carrier, thereby restraining carrier from adhering to the image bearing member.

Patent document 3 discloses an image forming apparatus which measures degradation of a developer on the basis of an electric current through a developer and if the degradation measurement exceeds a preset reference value, performs a process to exchange the developer or similarly extend the life of the developer. Owing to the extended life of the developer, the image forming apparatus can continue forming good images. The device also addresses other problems, including the following ones. Charging capability of the carrier deteriorates due to toner being spent on the carrier and for other reasons, which hampers toner from being sufficiently charged and causes low image density. Another problems that can be addressed by the device is scattering toner and a resultant dirty interior.

[Patent document 1] Japanese Unexamined Patent Publication No. 4-34573/1992 (Tokukaihei 4-34573; published Feb. 5, 1992)

[Patent document 2] Japanese Unexamined Patent Publication No. 2000-98730 (Tokukai 2000-98730; published Apr. 7, 2000)

[Patent document 3] Japanese Unexamined Patent Publication No. 4-80777/1992 (Tokukaihei 4-80777; published Mar. 13, 1992)

Beads carry over is known to intensify with an increasing electrical potential difference between the developer bearing member and the image bearing member as described in patent document 1. Therefore, the volume resistivity of the developer needs to be set so as to keep carrier adhering below a specified amount in the region of the image forming apparatus where a bias is applied.

Now, a correlation between the development bias voltage and the number of adhered carrier particles will be described for the two component developer. FIG. 17 is a graph representing experimental results of measurement of the number of carrier particles adhering per A4 sheet of paper when a development bias voltage is applied to two types of two component developers each containing a carrier of a different volume resistivity from the other.

In FIG. 17, the coated carrier has a core carrier with a resin coating and exhibits greater volume resistivity than the core carrier. Therefore, the developer containing the coated carrier has greater volume resistivity. The development bias is the value $V_{opc}$-$V_{dev}$, where $V_{opc}$ is the surface electrical potential of the image bearing member and $V_{dev}$ is the voltage applied to the development sleeve of the developer bearing member. Negatively charged toner is used in this exemplary experiment. For that reason, a positive bias region indicates an image region (solid black image region), and a negative bias region indicates a non-image region (background region).

The experimental results shown in FIG. 17 indicate beads carry over occurring both in the image region and the non-image region. The results confirm, as mentioned above, that the carrier is charged both positively and negatively and, again as mentioned above, that the number of adhered carrier particles increases with increasing development bias, for the following reasons. An increase in the development bias increases the current in the developer and the induced electric charge. The results further indicate that beads carrier over occurs less with the developer containing the coated carrier than with the developer containing the core carrier. It is appreciated from that fact that increasing the volume resistivity of the developer is an effective way of preventing beads carry over and also that the volume resistivity of the developer, in other words, the current flow to the developer, needs to be managed and a solution needs to be devised according to changes over time in order to restrain beads carry over which intensifies with decreasing volume resistivity of the developer due to degradation over time.

Considering these phenomena, although the technology of patent document 1 alleviates beads carry over by reducing the development bias voltage, it leads to other electrical potential problems. The electrical potential difference between the developer bearing member and the image area on the image bearing member however decreases. That reduces the toner adhering in the image area and hence the concentration of an output image.

The technology of patent document 2 alleviates beads carry over by sensing a drop in resistance of the developer and changing the AC duty ratio of the development bias voltage. This is not trouble free either. Changing development conditions can lead to variations in image density, non-uniform imaging, poor resolution, and degradation of image quality.

The technology of patent document 3 determines degradation of the developer by sensing a decrease in current in the developer. In other words, the technology determines degradation based on an increase in the resistance of the developer and does not sense a decrease in the resistance of the developer. Therefore, the technology is not capable of alleviating beads carry over caused by a decrease in the resistance of the developer.

The present technology, conceived in view of these problems, has an objective of providing an image forming apparatus, an image forming method, an image forming computer program, and a storage medium for the program which, so as to enable formation of high quality images, prevents the carrier from adhering to the image bearing member due to decrease in the volume resistivity of the carrier as a result of degradion of the developer caused by use over an extended period of time.

DISCLOSURE OF TECHNOLOGY

In order to solve the foregoing problems, an image forming apparatus, including a development unit having (i) a developer bearing member, internally having magnetic field generation means, which is provided with a rotatable non-magnetic and conductive sleeve and which carries on its surface a developer containing carrier and toner; and (ii) a developer regulation member for regulating an amount of the developer supplied from the developer bearing member to an image bearing member, said image forming apparatus visualizing an electrostatic latent image formed on a surface of the image bearing member with the developer supplied from the development unit to the image bearing member, said image forming apparatus comprising: resistance detection means for measuring a volume resistivity of the developer on the surface of the developer bearing member; a resistance memory section for storing therein a preset volume resistivity; resistance comparison means for comparing the volume resistivity of the developer which has been measured by the resistance detection means with the preset volume resistivity stored in the resistance memory section; and control means for carrying out a process for replacing the developer or the carrier if the volume resistivity of the developer is lower than the preset volume resistivity.

Further, in order to solve the foregoing problems, an image forming method is an image forming method, in which a developer containing carrier and toner is attached to a surface of a developer bearing member internally having magnetic field generation means and provided with a rotatable non-magnetic and conductive sleeve, and an amount of the developer supplied from the developer bearing member to an image bearing member is regulated by a developer regulation member, and an electrostatic latent image formed on a surface of the image bearing member is visualized with the developer, said image forming method comprising the steps of: (i) measuring a volume resistivity of the developer on the surface of the developer bearing member; (ii) a resistance memory section for storing a preset volume resistivity; (iii) comparing the volume resistivity of the developer which has been measured in the step (i) with the preset volume resistivity stored in the resistance memory section; and (iv) carrying out a process for replacing the developer or the carrier if the volume resistivity of the developer is lower than the preset volume resistivity.

According to the arrangement, the resistance detection means measures the volume resistivity of the developer on the surface of the developer bearing member, and the resistance comparison means compares the volume resistivity with the preset volume resistivity stored in the resistance memory section. Further, in case where the volume resistivity of the developer is lower than the preset volume resistivity, the process for replacing the developer or the carrier is carried out.

The developer in general only consumes the toner. The carrier therefore remains in the development unit over an extended period of time. Thus, particularly the carrier is repeatedly placed under mechanical stress, for example, in friction with the developer regulation member and the image bearing member and collision and abrasion with the carrier itself in the development unit, which decreases the volume resistivity of the carrier with time passage. The decreased volume resistivity induces charging of the carrier in a development area where the image bearing member faces the developer bearing member. The phenomenon results in the carrier adhering to the image bearing member. As a result, a white spot or image overlapping occurs.

In contrast, according to the foregoing arrangement, if the volume resistivity of the developer is lower than the preset volume resistivity, the decrease of the volume resistivity is regarded as deterioration of the developer, and the process for replacing the developer or the carrier is carried out. As a result, the volume resistivity of the developer in the development unit can be kept at a certain level or higher. Thus, it is possible to suppress charging of the carrier which is induced by the volume resistivity decreased with long-term use of the developer, so that the carrier is less likely to adhere to the image bearing member. Since the carrier is less likely to adhere to the image bearing member, it is possible to form a high quality image free from any white spot or image overlapping.

Note that, examples of the process for replacing the developer or the carrier include: a process for notifying the user of a command to replace the developer or the carrier; a process for supplying new developer or carrier; and the like.

Note that, the image forming apparatus may be realized by a computer. In this case, also (i) a control program which causes a computer to operate as the respective means so as to realize the image forming apparatus by the computer and (ii) a computer-readable storage medium containing the program are included in the scope of the present technology.

Additional objects, features, and strengths will be made clear by the description below. Further, the advantages will be evident from the following explanation in reference to the drawings.

REFERENCE NUMERALS

1 Image forming apparatus
10 Development Unit
11 Two Component Developer (Developer)
12 Developer bearing member
13 Developer Regulation Member (Opposite Electrode)
14 Resistance Detection Section (Resistance Detection Means)
15 Resistance Comparison Section (Resistance Comparison Means)
16 Resistance Memory Section
17 Control Section (Control Means)
18 Current Measurement Section (Current Measurement Means)
21 Image bearing member
22 Toner Concentration Detection Section (Toner Concentration Detection Means)
50 Conductive Metal Sleeve (Opposite Electrode)
51 Cleaning Blade
100 Display Section
110 Signal Transmission Section (Signal Transmission Means)
111 Service Center
120 Developer Replacing Section (Developer Replacing Means)
121 Collecting Unit
122 Supply Unit
130 Counting Section (Counting Means)
131 Count Memory Section
132 Count Comparison Section (Count Comparison Means)
150 Unit Replacement Detection Section (Unit Replacement Detection Means)
160 Carrier
161 Toner

DETAILED DESCRIPTION OF PREFERRED EMBODIMENTS

The following will describe embodiments in reference to FIGS. 1 to 15. The present technology is by no means limited to the embodiments.

Figure 2:
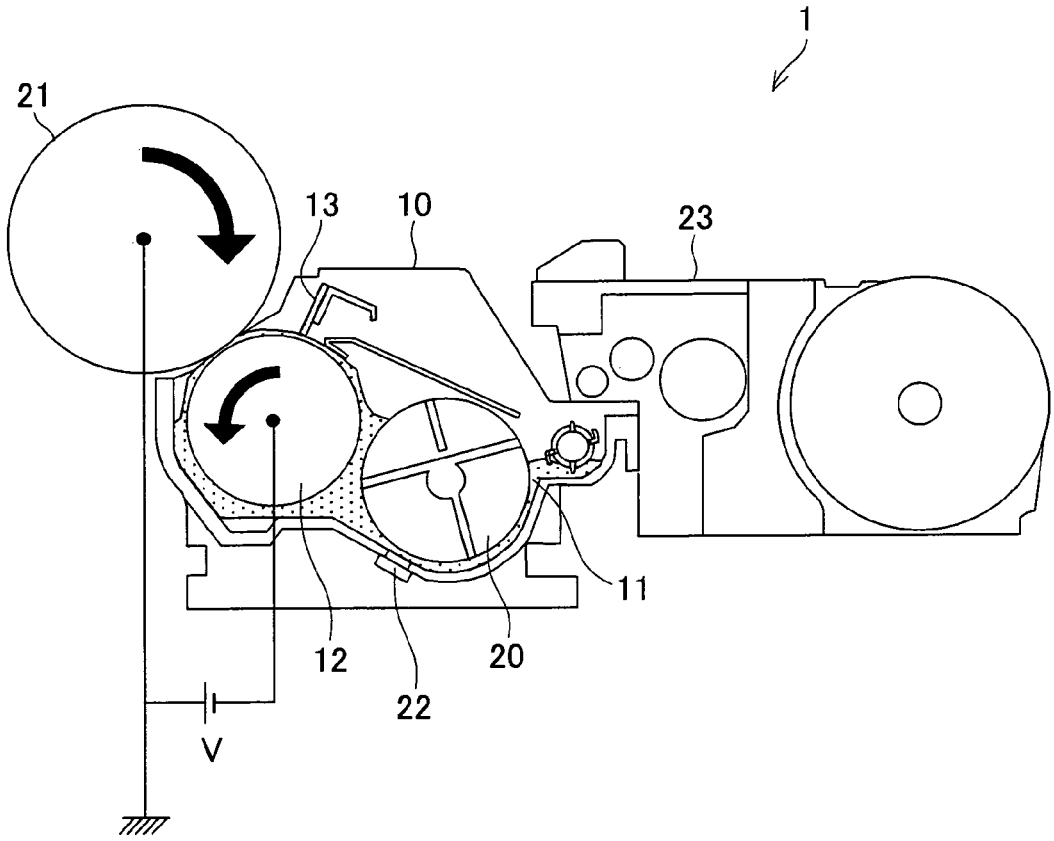
FIG. 2 A schematic of primary components of the image forming apparatus.
Figure 16:
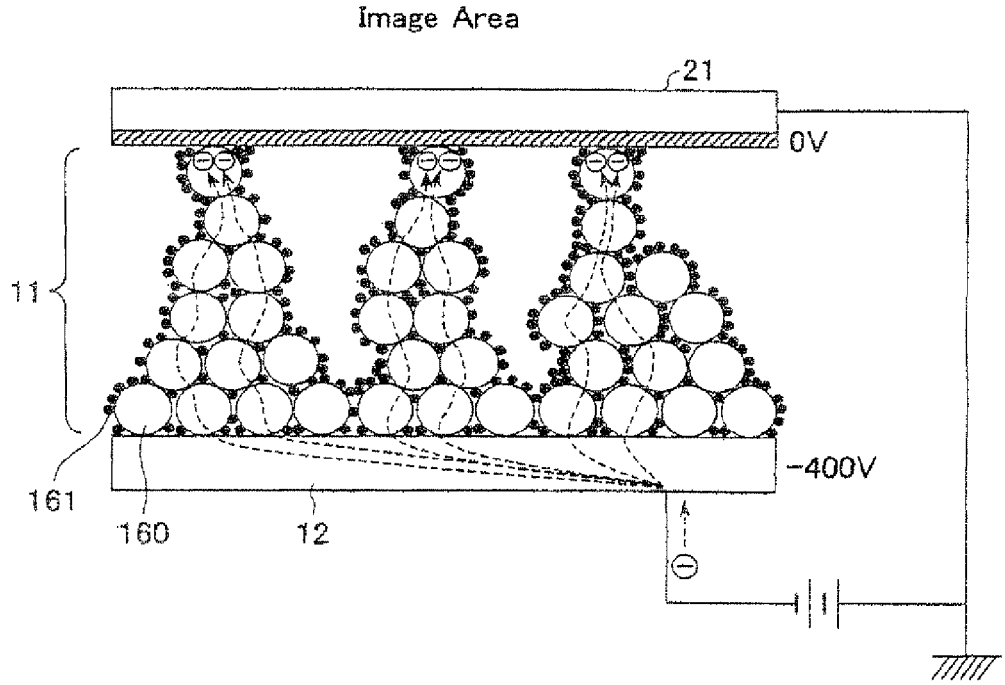
FIG.16 (PRIOR ART)
FIG. 16 Both (a) and (b) are an illustration of electric charge being induced by an electric field acting between a developer bearing member and an image bearing member in an image forming apparatus using a conventional two component developer.
Figure 16:
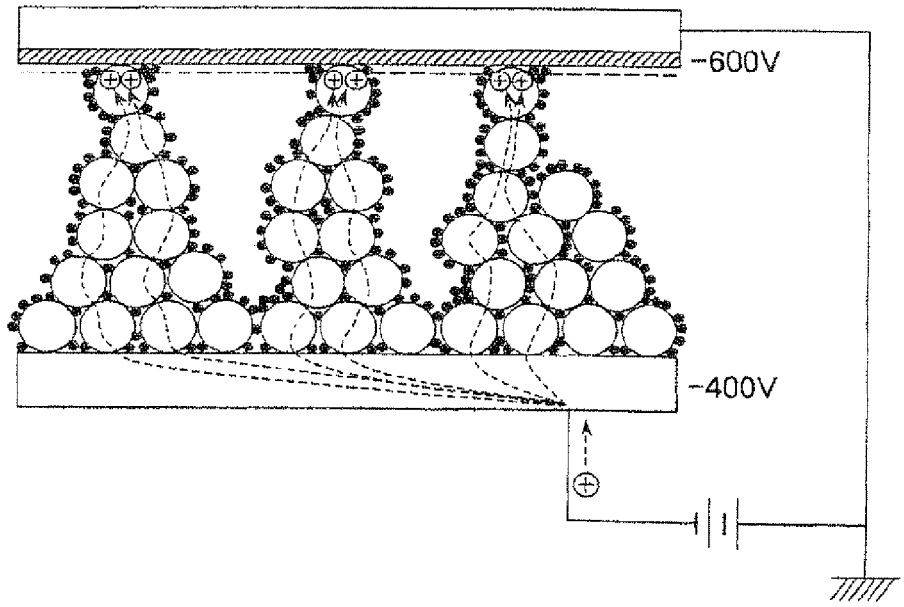
FIG.16 (PRIOR ART)
Figure 17:
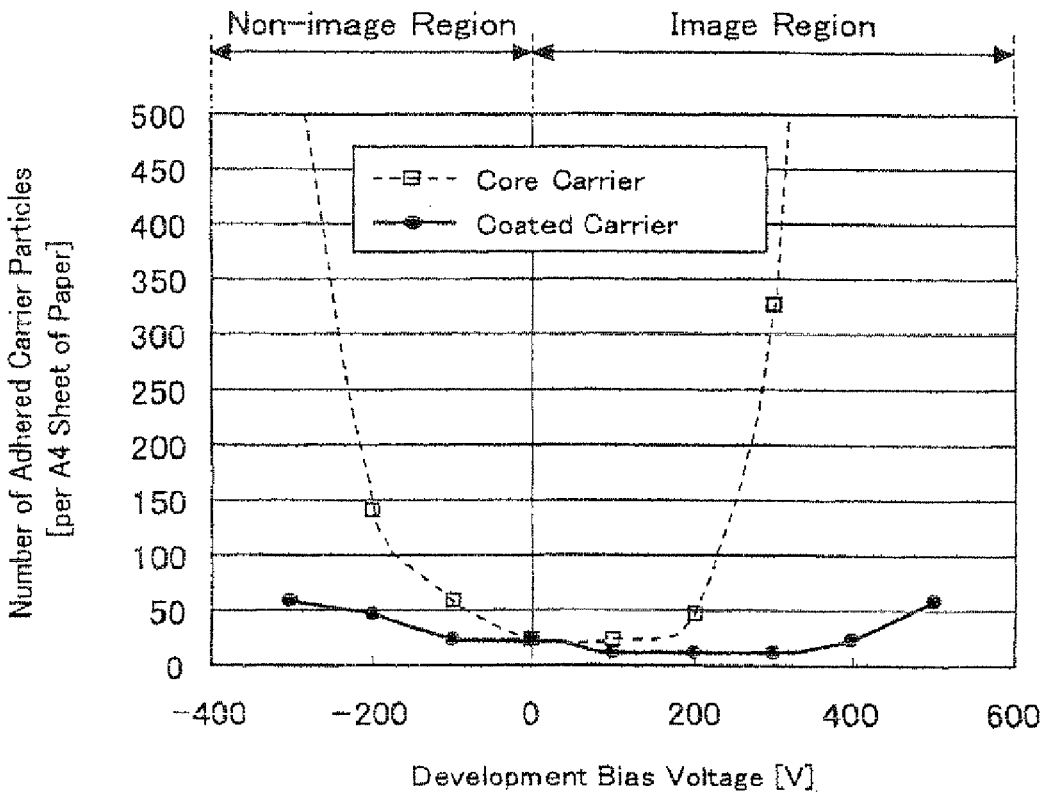
FIG.17 (PRIOR ART)
FIG. 17 A graph representing development bias dependence of the number of carrier particles adhering per A4 sheet of paper on an image bearing member surface when an image forming apparatus is used which uses two types of two component developers each containing a magnetic carrier of a different volume resistivity from the other.

FIG. 2 is a schematic of primary components of an image forming apparatus 1 of the present embodiment. In the image forming apparatus 1, as illustrated in FIG. 2, a two component developer (developer) 11 composed of a magnetic carrier and a non-magnetic toner is loaded beforehand into the development unit 10 is stirred and electrically charged by a stirring screw 20. As the two component developer 11 is transported to a developer bearing member 12 in which there is provided a magnetic roller (magnetic field generation means), the two component developer 11 is attracted to the surface of the developer bearing member 12 by magnetic binding force. The two component developer 11 held on the surface of the developer bearing member 12 is regulated to uniform thickness by a developer regulation member 13 and forms a magnetic brush where the developer bearing member 12 faces an image bearing member 21 (FIGS. 16(*a*) and 16(*b*)). Only the toner is transferred and made to adhere to an electrostatic latent image on the surface of the image bearing member 21 by charging means and exposure means (not shown), forming a visible image. The image forming apparatus 1 includes a toner concentration detection section (toner concentration detection means) 22 to maintain toner concentration in the two component developer 11 in the development unit 10 substantially constant. Specifically, the toner concentration detection section 22 detects the concentration of the toner (ratio in weight of the toner to the developer). If the detected toner concentration is below a predetermined value, a toner hopper 23 supplies new toner until the toner concentration reaches a preset value. This way, the toner concentration in the two component developer 11 in the development unit 10 is maintained substantially constant although toner is being consumed in the formation of visible images.

In the present embodiment, the bias voltage applied to the developer bearing member 12 is set to −400 V, whilst the electrical potential difference, $V_{opc}$-$V_{dev}$, between the image bearing member 21 and the developer bearing member 12 in the formation of a visible image is set to −100 V to 400 V.

The magnetic roller located inside the developer bearing member 12 in the image forming apparatus 1 has a total of five magnetic poles. Of those poles, the one that is positioned in a developing area where the developer bearing member 12 faces the image bearing member 21 has a magnetic flux density of 110 [mT] in a normal direction. These numeric values are mere examples and by no means limiting. The gap between the developer bearing member 12 and the developer regulation member 13 and the gap between the developer bearing member 12 and the image bearing member 21 in the developing area are both set to 0.45 [mm] in this exemplary experiment. This numeric value is again a mere example and by no means limiting.

For the image forming apparatus 1, a magnetic carrier with a volume average particle diameter $\phi$=50 μm having a surface coated with silicone resin and a non-magnetic toner purified by pulverization to have a volume average particle diameter $\phi$=6.5 μm are used for the two component developer 11. The magnetic carrier has a density of 4.7 [g/cm$^3$], the non-magnetic toner has a density of 1.0 [g/cm$^3$]. The two component developer 11 has a constant toner concentration of 5 wt %.

The two component developer 11 in general only consumes non-magnetic toner. The magnetic carrier therefore remains in the development unit 10 over an extended period of time. Accordingly, the magnetic carrier repeatedly placed under mechanical stress, for example, in friction with the stirring screw 20, the developer regulation member 13, and the image bearing member 21 and collision and abrasion with the carrier itself in the development unit 10. The resin layer with which the core surface is covered scrapes or peels off over time, which reduces the volume resistivity of the carrier.

Figure 3:
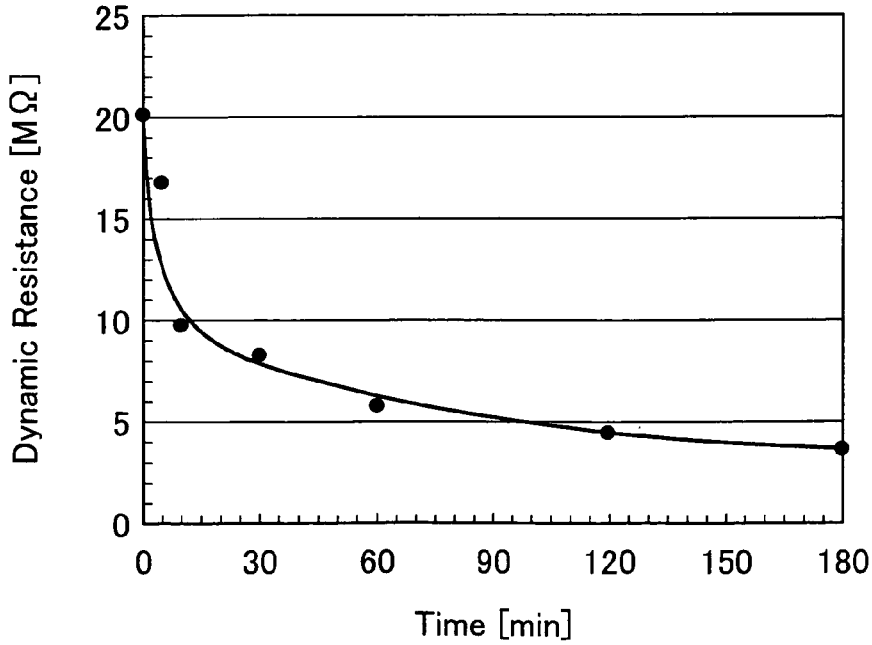
FIG. 3 A graph representing an example of decreasing volume resistivity of a magnetic carrier used in the image forming apparatus.

Results of an experiment conducted as evidence of decreasing volume resistivity of the carrier will be described. FIG. 3 is a graph showing dynamic resistance of the carrier versus time. The development unit 10 only contained the carrier. The image bearing member 21 was a conductive aluminum sleeve. The dynamic resistance was obtained from the current flow which occurred when a voltage of 400 V was applied between the developer bearing member 12 and the image bearing member 21.

The peripheral speeds of the developer bearing member 12 and the image bearing member 21 were set to 450 mm/sec and 225 mm/sec respectively. The ratio of the peripheral speed of the developer bearing member 12 to that of the image bearing member 21 was set to 2. While idling the developer bearing member 12 and the image bearing member 21 under these conditions, the dynamic resistance value was sampled at certain times. Results are shown in FIG. 3, which demonstrates that the dynamic resistance of the carrier tends to decrease with time.

We observed the carrier before idling and after 180 minutes of idling under a field-emission scanning electron microscope (FE-SEM). The observation revealed that the coating resin of the carrier after 180 minutes of idling peeled off noticeably when compared with the pre-idling carrier coated well with the coating resin. A similar experiment was conducted with a two component developer which was a toner/carrier mixture. Results were similar to the previous experiment which involved only carrier in that we observed decrease in the dynamic resistance of the carrier after 180 minutes of idling and peel-off of the coating resin on the carrier surface.

These experiments confirm that the stirring of the two component developer 11 in the development unit 10 over an extended period of time causes the coating resin covering the carrier surface to peel off and the volume resistivity of the carrier to decrease. The decreased carrier volume resistivity induces charging of the carrier. The phenomenon results in the carrier adhering to the image bearing member 21. That in turn produces white spots in the image, degrading image quality.

From the discussion above, it would be appreciated that to form a high quality image, the two component developer 11 needs to have a specified volume resistivity that is predetermined based on a threshold value for beads carry over. To do that, decrease in the volume resistivity of the two component developer 11 needs to be managed to maintain the volume resistivity at a level not less than a certain value.

Accordingly, the image forming apparatus 1 of the present embodiment manages decrease in the volume resistivity of the two component developer 11, thereby prevents the carrier from adhering to the image bearing member 21 to realize high quality image formation. The following will describe the specific structure of the image forming apparatus 1.

Figure 1:
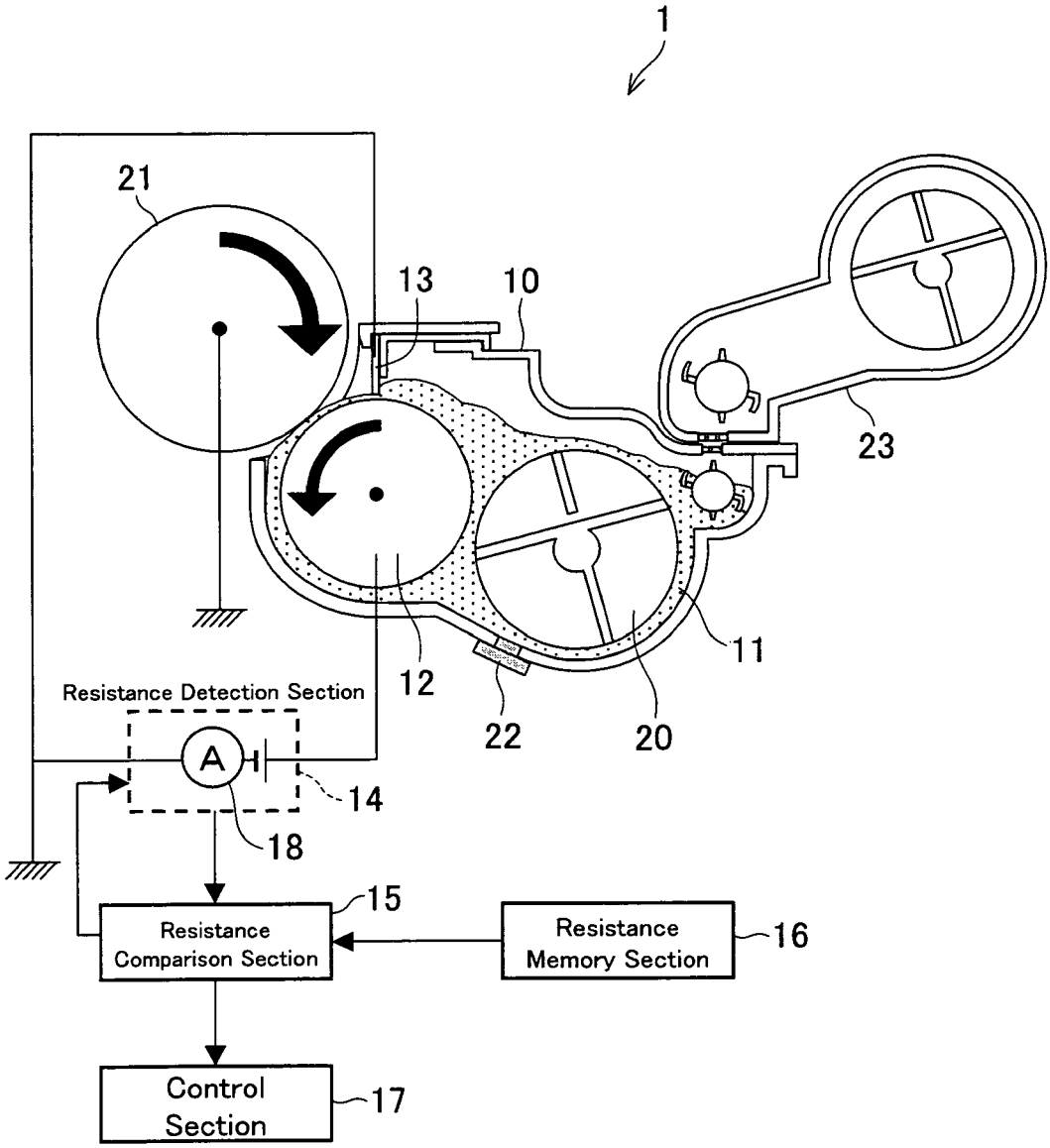
FIG. 1 A schematic of an exemplary structure of the image forming apparatus which determines whether a two component developer has been degraded and if it has, prompts replacement of the two component developer.

The image forming apparatus 1, as illustrated in FIG. 1, includes the two component developer 11, the developer bearing member 12, the opposite electrode (developer regulation member) 13, a resistance detection section (resistance detection means) 14, a resistance comparison section (resistance comparison means) 15, a resistance memory section 16, and a control section (control means) 17. The opposite electrode 13 doubles as the developer regulation member which regulates the supply to the image bearing member 21 of the two component developer 11 being attracted to the developer bearing member 12.

A process performed by the image forming apparatus 1 will be described in reference to FIG. 1. First, the resistance detection section 14 measures the current in the two component developer 11 located between the developer bearing member 12 and the opposite electrode 13 from the electrical potential difference between the developer bearing member 12 and the opposite electrode 13 and calculates the volume resistivity of the two component developer 11 from the measurement. The method of calculation of the volume resistivity of the two component developer 11 implemented by the resistance detection section 14 will be detailed later. Next, the resistance comparison section 15 compares the obtained volume resistivity with the specified volume resistivity stored in advance in the resistance memory section 16. If the volume resistivity calculated by the resistance detection section 14 is less than the specified volume resistivity, the control section 17 executes a process to replace the two component developer 11 or the carrier. The specific process executed by the control section 17 will be detailed later.

Now, the method of calculating the volume resistivity $\rho$ with the resistance detection section 14 will be specifically described.

Figure 4:
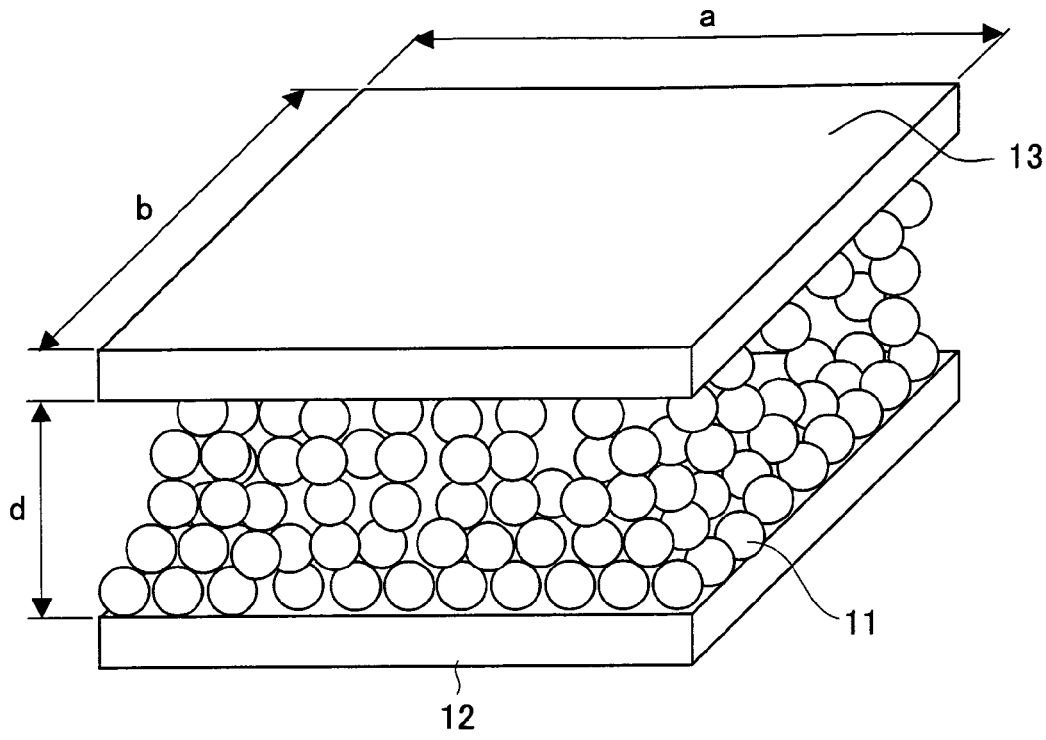
FIG. 4 A supplementary illustration for the description of how the volume resistivity of a magnetic carrier is derived.

First, with an electrical potential difference, $V=|Vd-Vo|$, being applied between the developer bearing member 12 (electrical potential=Vd) and the opposite electrode 13 (electrical potential=Vo), the current, I, in the two component developer 11 located between the developer bearing member 12 and the opposite electrode 13 is measured with an current measurement section (current measurement means) 18 provided in advance in the resistance detection section 14. Next, the resistance R is calculated from the electrical potential difference V and the current I as measured by the current measurement section 18 using the equation $R=V/I$. As illustrated in FIG. 4, the contact area S of the opposite electrode 13 with the two component developer 11 carried on the developer bearing member 12 is obtained by $S\ [cm^2]=a[cm]\times b\ [cm]$. Assuming that the developer bearing member 12 is separated from the opposite electrode by a gap d[cm], the volume resistivity is calculated by the equation $\rho[\Omega\cdot cm]=R\cdot S/d$.

Figure 5:
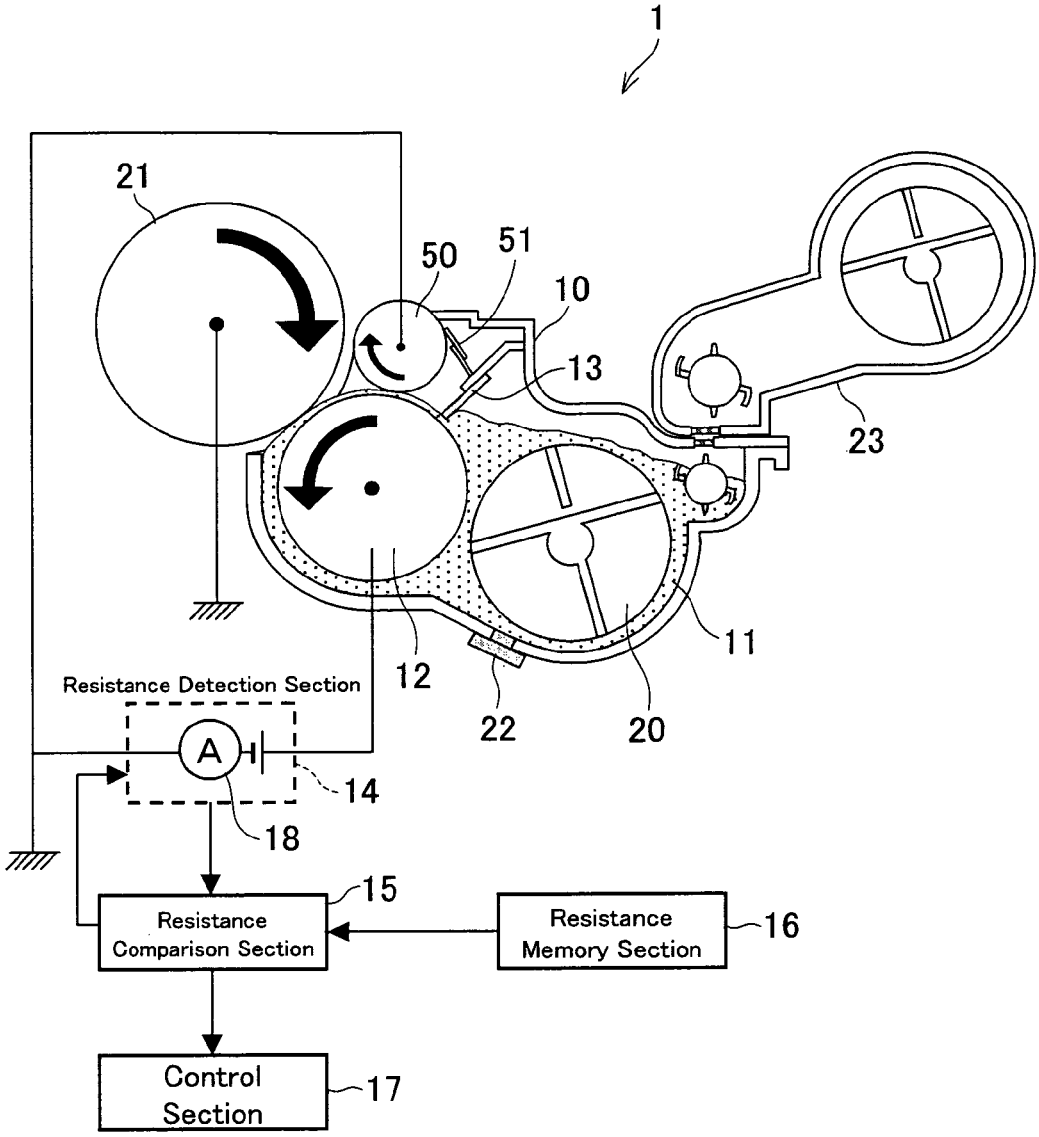
FIG. 5 A schematic of a structure when the opposite electrode used in measuring the resistance of a two component developer for use the image forming apparatus is a rotatable conductive metal sleeve.

The opposite electrode 13 in the present embodiment is a conductive, developer regulation member. Alternatives are also possible: the electrode 13 may be, for example, a rotatable conductive metal sleeve 50 as illustrated in FIG. 5. A small amount of carrier or toner can adhere to the conductive metal sleeve 50 where it faces the developer bearing member 12 because of mechanical abrasion and other reasons. When that happens, the volume resistivity may not be measured accurately. Therefore, the conductive metal sleeve 50 is preferably provided with a cleaning blade 51 scraping off the carrier and toner. The structure always maintains a clean surface for the opposite electrode, enabling stable and highly reliable measurement of the volume resistivity of the developer.

The conductive metal sleeve 50 is preferably located downstream of the developer regulation member 13 with respect to the direction of the rotation of the developer bearing member 12 because the amount of the two component developer 11 attracted to the surface of the developer bearing member 12 is more stable there. The structure enables stable volume resistivity measurement.

The conductive metal sleeve 50 is preferably located upstream of the place where the developer bearing member 12 faces the image bearing member 21 for the following reasons. If the conductive metal sleeve 50 is located downstream of the place where the developer bearing member 12 faces the image bearing member 21, any amount of toner can be consumed, causing a toner weight mix ratio to vary. In such circumstances, the volume resistivity may change even if the coating state of the carrier remains unchanged.

During measurement of the volume resistivity, the electrical potential Vd of the developer bearing member 12 and the electrical potential Vo of the conductive metal sleeve (opposite electrode) 50 preferably has a relationship Vo>Vd when the toner is positively charged and Vo<Vd when the toner is negatively charged. The toner does not move from the developer bearing member 12 to the conductive metal sleeve 50 under these conditions. The toner is stably supplied to the image bearing member 21.

The resistance detection section 14 preferably detects the volume resistivity of the two component developer 11 when the toner concentration detected by the toner concentration detection section 22 meets predetermined conditions. Specifically, the toner concentration detection section 22 includes a toner concentration sensor sensing toner concentration, a toner concentration calculation section calculating toner concentration as represented by the ratio of the toner weight to the weight of the developer on the basis of an output signal of the toner concentration sensor, a toner concentration memory section storing specified toner concentration, and a toner concentration comparison section comparing the toner concentration calculated by the toner concentration calculation section with the specified toner concentration. When the toner concentration meets the specified conditions, the resistance detection section 14 detects the volume resistivity of the two component developer 11. The processes implemented by the toner concentration calculation section and the toner concentration comparison section may be implemented by the resistance detection section 14.

Figure 6:
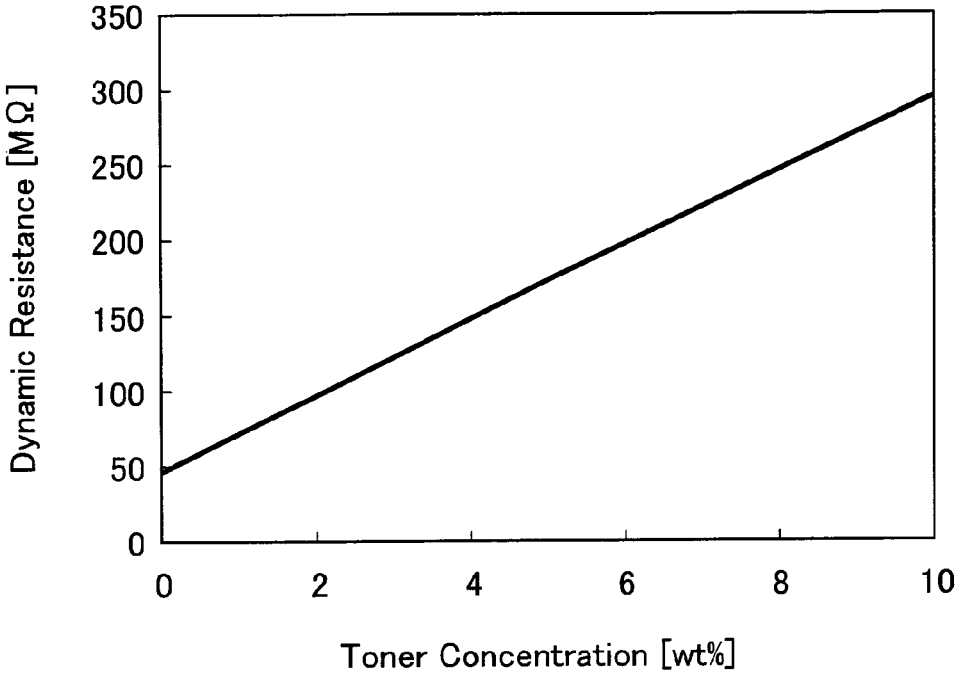
FIG. 6 A graph representing an exemplary correlation between the toner concentration and the dynamic resistance of a two component developer.

FIG. 6 is a graph representing an example of the correlation between toner concentration and dynamic resistance. The dynamic resistance values in FIG. 6 are those of the two component developer 11 obtained from the value of the current in the two component developer 11 when a 400-V voltage is applied between the developer bearing member 12 and the image bearing member (here, a conductive aluminum sleeve) 21.

It would be appreciated from FIG. 6 that the dynamic resistance changes greatly with a small change in the toner concentration. When the toner concentration has not reached a specified value, that is, below a specified value of 5 wt %, if the resistance detection section 14 measures the volume resistivity of the two component developer 11, the measurement is smaller than it should be. As a result, the two component developer 11 is determined to have deteriorated. The control section 17 then executes a process to replace the two component developer 11 or the carrier. This is a malfunction. Therefore, the resistance detection section 14 needs to operate only when the toner concentration is greater than or equal to the specified value.

Next will be described a method of determining the specified volume resistivity stored in advance in the resistance memory section 16. The specified volume resistivity is determined based on the following experiment.

Figure 7:
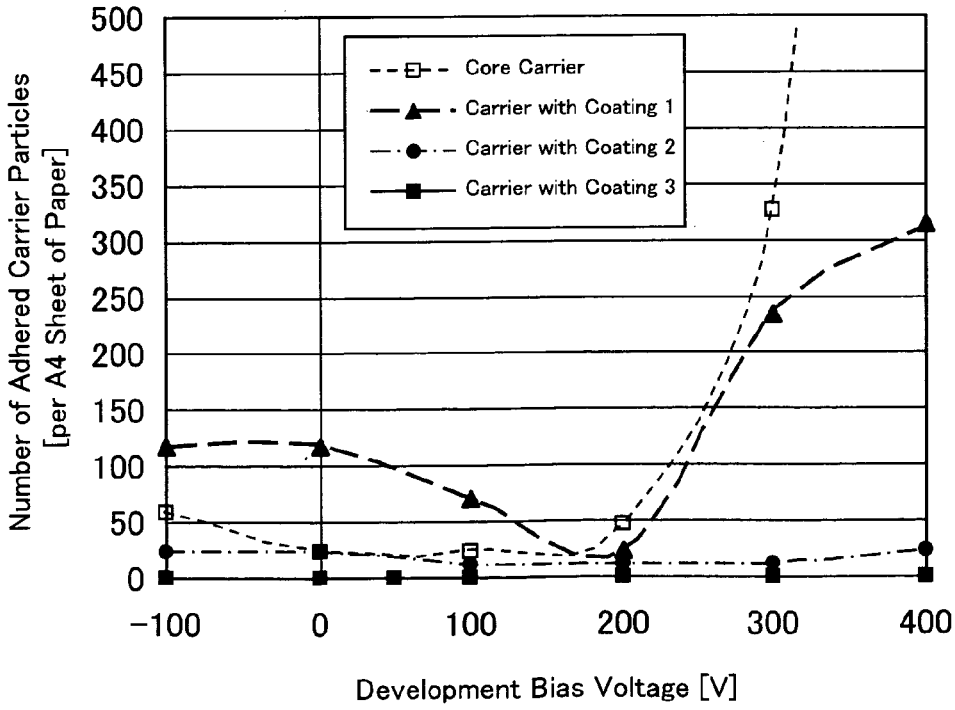
FIG. 7 A graph representing measurement of development bias dependence of the number of carrier particles adhering per A4 sheet of paper on an image bearing member surface for two component developers containing magnetic carriers of different coatings on identical cores.

FIG. 7 is a graph in which the number of carrier particles adhering to the image bearing member 21 per A4 sheet of paper are plotted against development bias for developers containing four carriers of different volume resistivity. The carriers had the same toner concentration of 5 wt %. One of the four carriers used in the experiment was ferrite carrier cores with no coating layer which had a volume average particle diameter of 50 [μm] and contained magnetically saturated (65 [emu/g]) magnesium. The other three carriers were the same ferrite carrier cores with resin coating (coating 1, coating 2, and coating 3 respectively). The volume resistivities of the carriers had a relationship, Core<Coating 1<Coating 2<Coating 3. Coatings 1 to 3 were made of silicone resin. Coating 1 was 0.5 μm thick, and coatings 2 and 3 were 1 μm thick. The cores were coated by immersion. Other coating methods could be used.

Coatings 1 to 3, although being made of the same coating resin, exhibited different volume resistivities presumably for the following reasons. Coating 1 was thinner, hence had a smaller volume resistivity, than coatings 2 and 3. Coating 3 had a greater volume resistivity than coating 2 probably because coating 3 formed a more uniform coating layer.

Results of the experiment shown in FIG. 7 show that a carrier with a higher volume resistivity adheres less. This is especially true with the carriers with coatings 2 and 3 which adhere only in greatly reduced amounts.

Recall that the carrier adhering to the image bearing member 21 becomes noticeable when the electrical potential difference $V_{opc}-V_{dev}$ between the image bearing member 21 and the developer bearing member 12 is increased. Therefore, we now focus on the carrier adhering characteristics of the image forming apparatus 1 of the present embodiment at a maximum electrical potential difference of 400 V.

Figure 8:
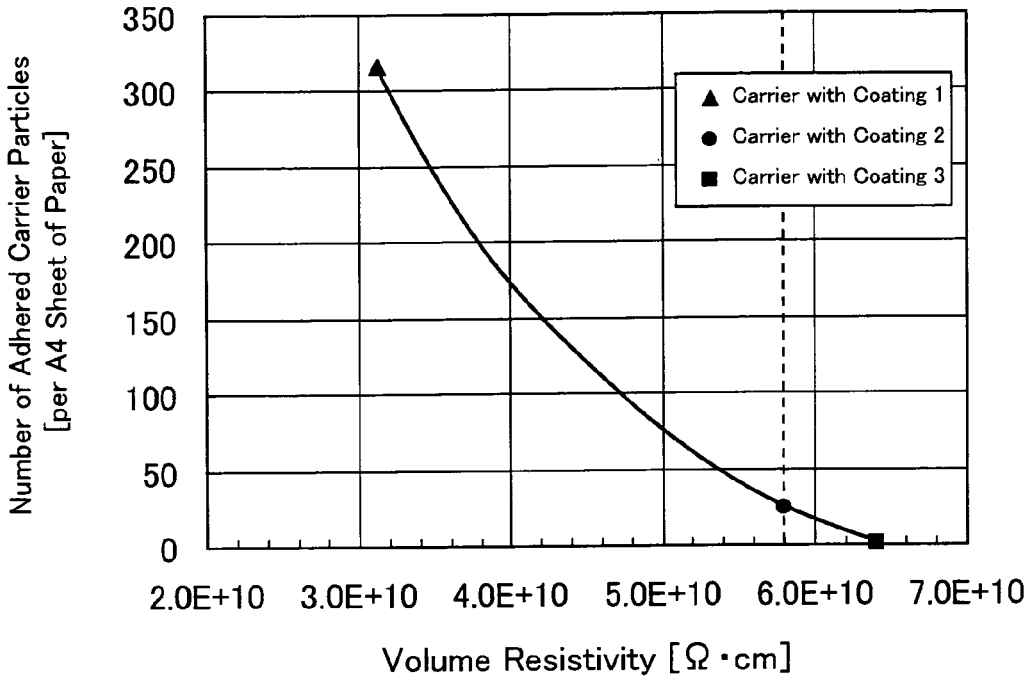
FIG. 8 A graph representing a correlation between volume resistivity and the number of adhered carrier particles for two component developers containing magnetic carriers of different coatings on identical cores under a development bias of 400 V.

FIG. 8 is a graph in which the number of carrier particles adhering to the image bearing member 21 per A4 sheet of paper are plotted against volume resistivity on the horizontal axis for carriers 1 to 3 with a 400-V voltage being applied to the developer bearing member 12. FIG. 8 shows no plots for the core carrier because excess current occurred, making volume resistivity measurement impossible, when a 400-V was applied. The volume resistivity was measured in the contact area of the image bearing member (here, a conductive sleeve) 21 with the two component developer 11 attracted onto the developer bearing member 12 with a 0.45 [mm] gap between the developer bearing member 12 and the conductive sleeve while a 400 [V] electrical potential difference was being applied between the developer bearing member 12 and the conductive sleeve. The contact area S [$cm^2$] needed for volume resistivity calculation was 15 [$cm^2$].

FIG. 8 clearly shows that the carriers with coating 2 and coating 3 adhering less. These facts demonstrate that setting the volume resistivity of the two component developer 11 to a value greater than or equal to $5.8\times10^{10}$ [Ω·cm] effectively reduces the carrier adhering to the image bearing member 21. Furthermore, from results of measurement of the carrier with coating 3, the volume resistivity of the two component developer 11 is preferably set to a greater than or equal to $6.4\times10^{10}$ [Ω·cm].

In this exemplary experiment, the peripheral speeds of the developer bearing member 12 and the image bearing member 21 were set to 450 mm/sec and 225 mm/sec. The ratio of the peripheral speed of the developer bearing member 12 to that of the image bearing member 21 was set to 2. Qualitatively equivalent results were obtained when the peripheral speed of the image bearing member 21 was changed to 150 mm/sec and 360 mm/sec while keeping the same peripheral speed ratio.

The volume resistivity used in the experiment was the volume resistivity $\rho_0$ measured, when the image bearing member 21 was a conductive sleeve, between the developer bearing member 12 and the conductive sleeve. Therefore, the specified volume resistivity $\rho_1$ stored in advance in the resistance memory section 16 needed to be obtained in reference to $\rho_0$. As mentioned earlier, the volume resistivity $\rho$ is obtained by the equation of the first degree $\rho$ [Ω·cm]=R·S/d where S is the contact area of the two component developer 11 with the opposite electrode, and "d" is the gap between the developer bearing member 12 and the opposite electrode. Therefore, $\rho_1$ is proportional to $\rho_0$. Accordingly, $\rho_1$ obtained by substituting $\rho_0=5.8\times10^{10}$ [Ω·cm] obtained from the experimental results to $\rho_1=a\rho_0$, an equation which holds between $\rho_0$ and $\rho_1$, where "a" is the proportionality constant can be defined as the specified volume resistivity.

Figure 9:
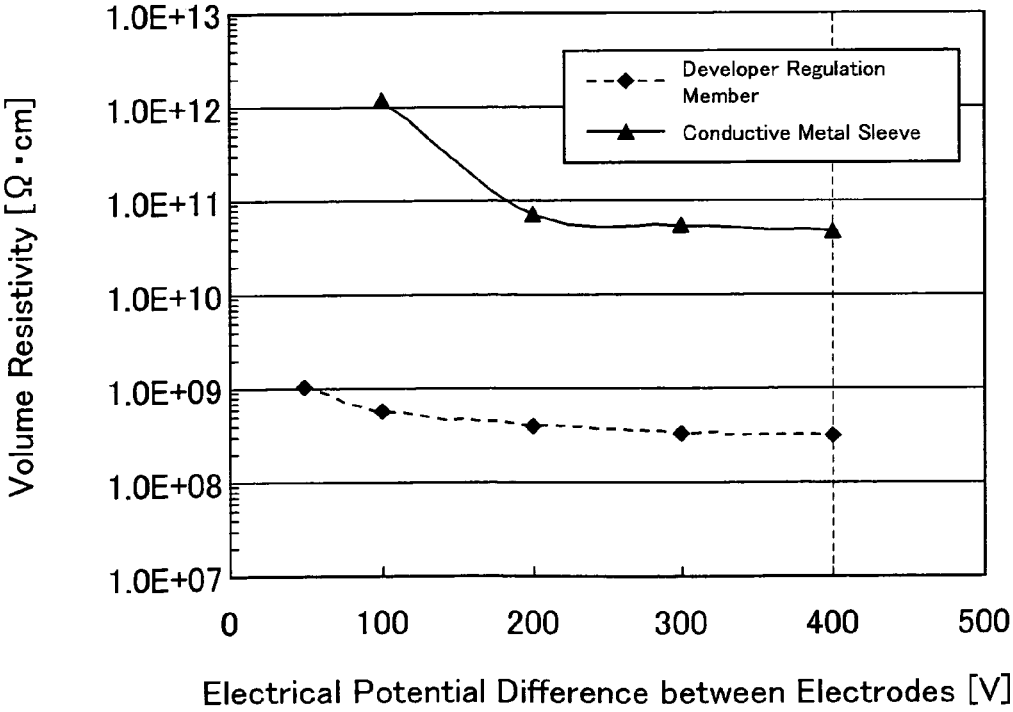
FIG. 9 A graph representing an exemplary correlation between electrical potential difference between electrodes and volume resistivity when different members are used as the opposite electrode for volume resistivity measurement.

FIG. 9 is a graph representing an example of the correlation between electrical potential difference between the developer bearing member 12 and the opposite electrode and the measured volume resistivity of the two component developer 11 when the developer regulation member 13 and a conductive sleeve were used as the opposite electrode in volume resistivity measurement.

FIG. 9 shows that the volume resistivity changes depending on where the opposite electrode faces the developer bearing member 12 and that the volume resistivity is smaller when the developer regulation member 13 is used as the opposite electrode, for the following reasons. The distribution of magnetic flux at the surface of the developer bearing member 12, hence the density of the two component developer 11 in a magnetic ear, change with the position of the opposite electrode. These facts gives another reason why the specified volume resistivity $\rho_1$ stored in advance in the resistance memory section 16 needs to be determined in reference to the volume resistivity $\rho_0$ as mentioned earlier.

Accordingly, as illustrated in FIG. 9, the volume resistivity at electrical potential difference 400 V is $3.2\times10^8$ [Ω·cm] for the developer regulation member 13 and $4.8\times10^{10}$ [Ω·cm] for the conductive metal sleeve. Therefore, if the opposite electrode used for the volume resistivity measurement in the image forming apparatus 1 is the developer regulation member 13, the specified volume resistivity $\rho_1$ equals $3.2\times10^8$ [Ω·cm], the reference volume resistivity $\rho_0$ is $4.8\times10^{10}$ [Ω·cm], and the constant of proportionality $a=6.7\times10^{-3}$ from $a=\rho_1/\rho_0$. In other words, when the two component developer 11 in this exemplary experiment is used and the opposite electrode is the developer regulation member 13, the specified volume resistivity $\rho_1$ stored in advance in the resistance memory section 16 is a value calculated by $\rho_1=6.7\times10^{-3}\times\rho_0$.

Process Implemented by Control Section 17

Next will be described specifically the process implemented by the control section 17 when the volume resistivity calculated by the resistance detection section 14 is below the specified volume resistivity stored in the resistance memory section 16.

Figure 10:
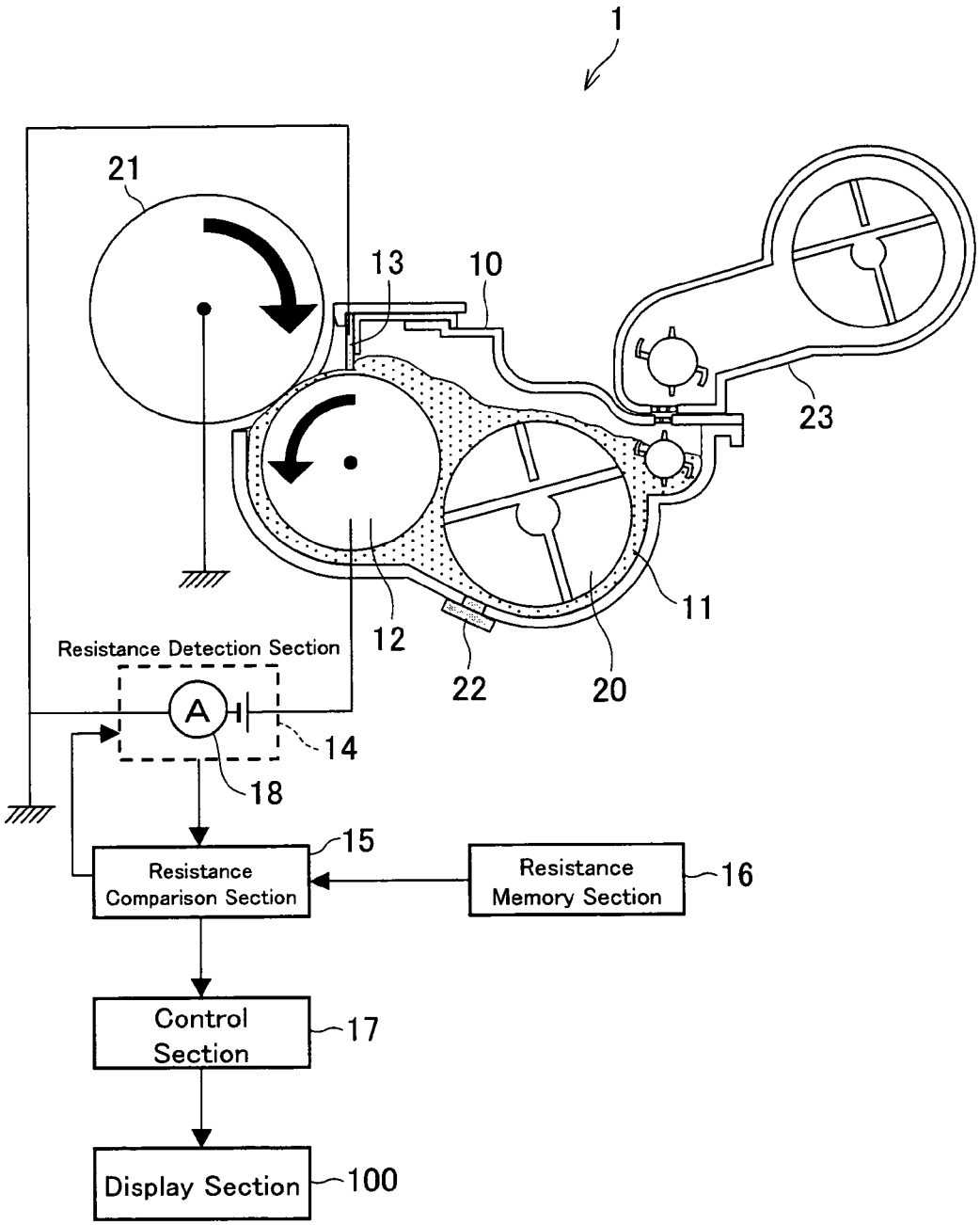
FIG. 10 A schematic of a structure of the image forming apparatus which determines whether a two component developer has been degraded and if it has, has displayed a message or alert lamp prompting replacement of a development unit.

FIG. 10 is a schematic of the primary components of the image forming apparatus 1, illustrating a process implemented by the control section 17 according to a first method. The first method displays a message or turns on an alert lamp on a display section 100 of the image forming apparatus 1 prompting the user to replace the development unit 10.

Specifically, first, the resistance detection section 14 measures the current in the two component developer 11 located between the developer bearing member 12 and the opposite electrode 13 from the electrical potential difference between the developer bearing member 12 and the opposite electrode 13 and calculates the volume resistivity of the two component developer 11 from the measurement.

Next, if the resistance comparison section 15 determines that the volume resistivity of the two component developer 11 calculated by the resistance detection section 14 is below the specified volume resistivity stored in the resistance memory section 16, the control section 17 instructs the display section 100 to display a message or turn on an alert lamp prompting the user to replace the development unit 10 so that the display section 100 turns on the message or the alert lamp. Accordingly, the user can recognize degradation of the two component developer. Formation of high quality images is continued.

If the resistance comparison section 15 determines that the volume resistivity of the two component developer 11 calculated by the resistance detection section 14 is not below the specified volume resistivity stored in the resistance memory section 16, the process returns to the calculation of volume resistivity by the resistance detection section 14.

The process implemented by the resistance detection section 14 and the resistance comparison section 15 is identical to the first method. The description of the process is not repeated in the following which focuses on the control section 17.

Figure 11:
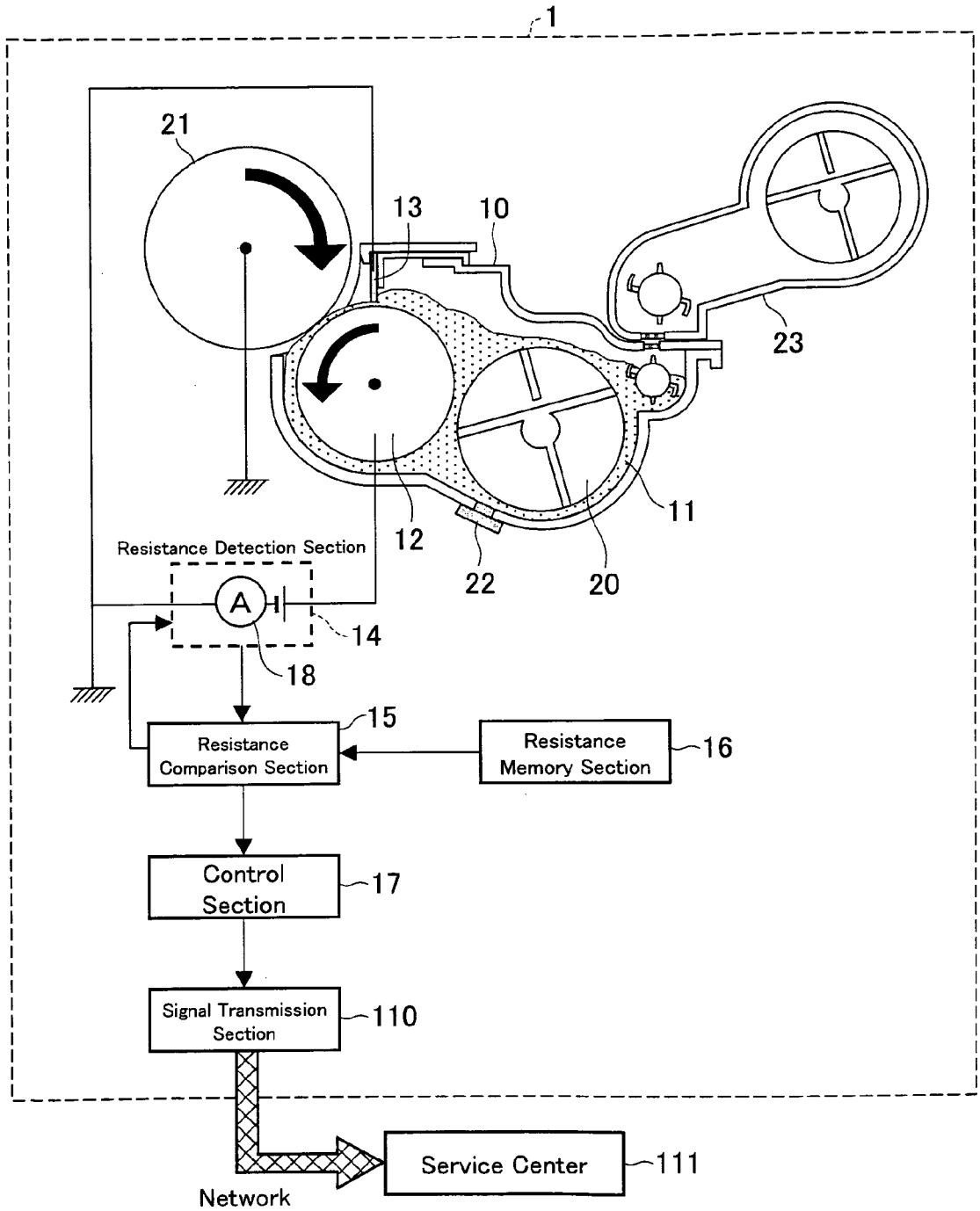
FIG. 11 A schematic of a structure of the image forming apparatus which determines whether a two component developer has been degraded and if it has, transmits to a service center a signal prompting replacement of the development unit.

FIG. 11 is a schematic of the primary components of the image forming apparatus 1, illustrating a process implemented by the control section 17 according to a second method.

In the second method, the image forming apparatus 1 includes a signal transmission section (signal transmission means) 110 transmitting signals to a service center 111 which supports maintenance work of the image forming apparatus 1. If the resistance comparison section 15 determines that the volume resistivity of the two component developer 11 calculated by the resistance detection section 14 is below the specified volume resistivity stored in the resistance memory section 16, the control section 17 instructs the signal transmission section 110 to transmit an alert signal to the service center 111 prompting the service center 111 to replace the development unit 10. The signal transmission section 110 then transmits the alert signal over a network to automatically request the service center 111 to replace the development unit 10.

Figure 12:
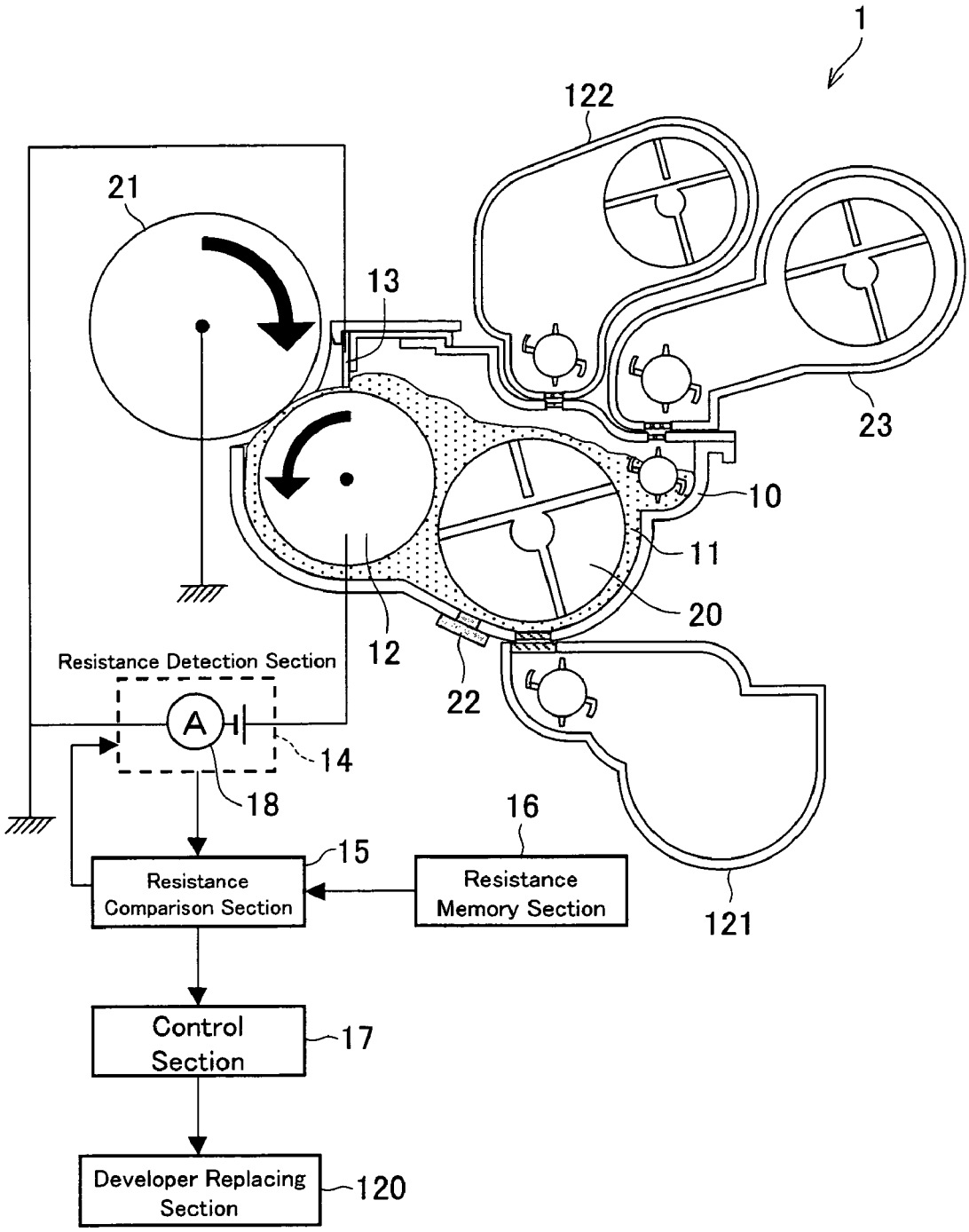
FIG. 12 A schematic of a structure of the image forming apparatus which includes developer replacing means, whereby the device determines whether a two component developer has been degraded and if it has, the means replaces the developer.

FIG. 12 is a schematic of the primary components of the image forming apparatus 1, illustrating a replacement process implemented by the control section 17 according to a third method.

In the third method, the image forming apparatus 1 further includes a collecting unit 121 collecting the two component developer 11 from the development unit 10, a supply unit 122 containing unused two component developer for supply to the development unit 10, and a developer replacing section (developer replacing means) 120. If the resistance comparison section 15 determines that the volume resistivity of the two component developer 11 calculated by the resistance detection section 14 is below the specified volume resistivity stored in the resistance memory section 16, the control section 17 instructs the developer replacing section 120 to replace the developer. Having received an instruct to replace the developer, the developer replacing section 120 first collects a predetermined amount of the two component developer 11 from the development unit 10 to the collecting unit 121. Next, the section 120 supplies an amount of unused developer which is equal to the amount of the collected two component developer 11 from the supply unit 122 to the development unit 10.

The supply unit 122 preferably contains an amount of developer that is an integral multiple of the predetermined amount of developer collected and supplied in replacing the developer for the following reasons. After a predetermined times of replacements, substantially no unused developer remains in the supply unit 122. The developer is less wasted, which allows for cost reduction.

The collecting unit 121 preferably has at least a sufficient capacity for the developer contained in the supply unit 122 for the following reasons. The collecting unit 121 only needs to provide a minimum capacity to collect degraded developer. The unit 121 does not need to have a greater capacity than it should. The structure allows for reduction in cost for materials for the unit and in size of the image forming apparatus 1. Furthermore, the unit 121 can be replaced simultaneously with the supply unit 122, which reduces replacement operations.

Figure 13:
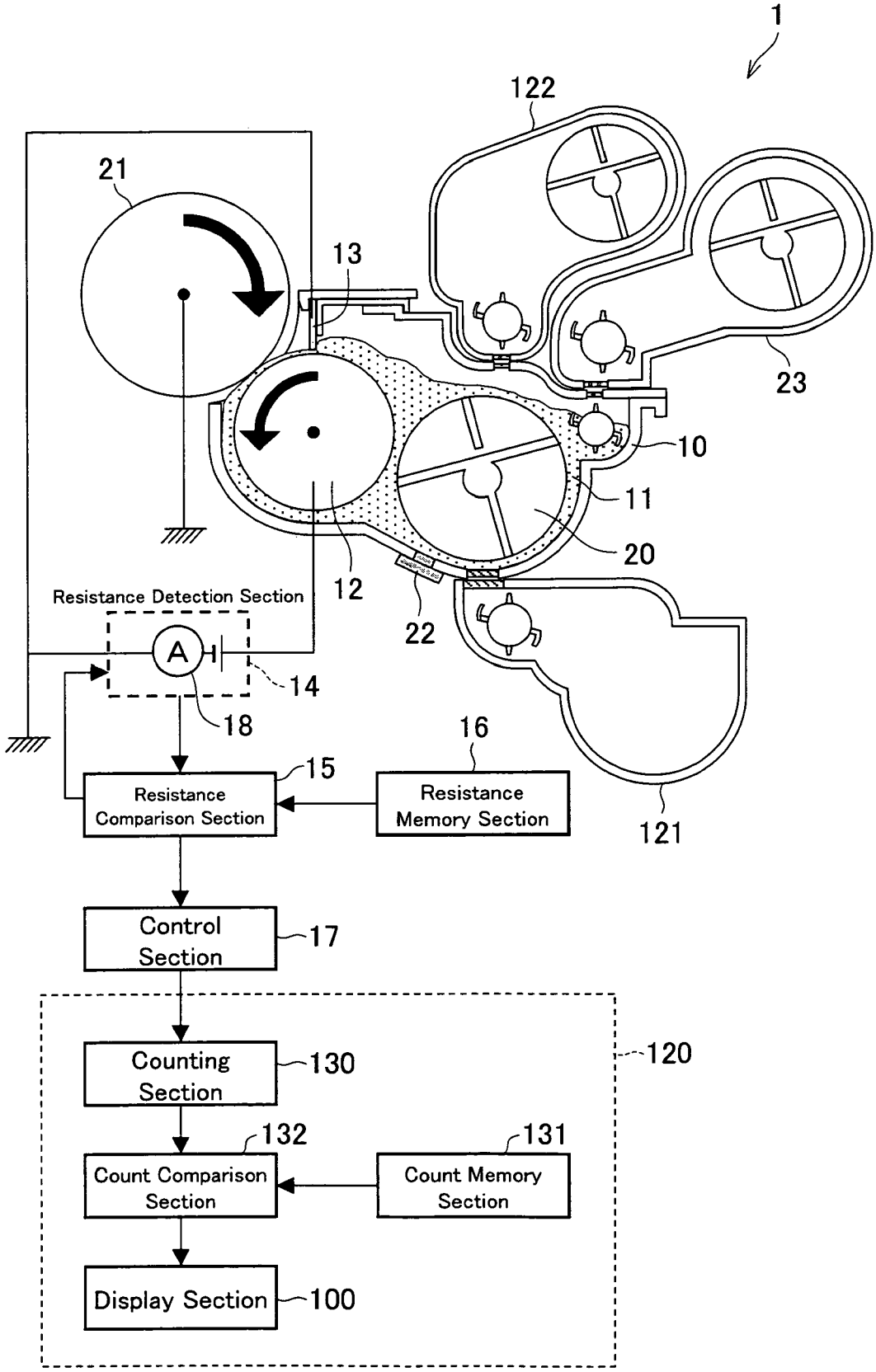
FIG. 13 An illustration of a structure of the image forming apparatus which after the developer replacing means is activated a predetermined number of times, has displayed a message or alert lamp prompting replacement of a collecting unit and a supply unit.

The developer replacing section 120, as illustrated in FIG. 13, preferably includes a counting section (counting means) 130 counting and recording replacement operations, a count memory section 131 storing a preset number of times replacement can be made (allowed replacement operation count), and a count comparison section (count comparison means) 132 comparing the replacement operation count provided by the counting section 130 with the allowed replacement operation count stored in the count memory section 131. When the replacement operation count has reached the allowed replacement operation count, the control section 17 preferably controls the display section 100 in the image forming apparatus 1 to display a message that the collecting unit 121 and the supply unit 122 need to be replaced Accordingly, a simple structure can recognize a timing for the replacement of the collecting unit 121 and the supply unit 122 and gives support to the user for immediate replacement operation. The user is alerted to the need to replace the collecting unit 121 and the supply unit 122 immediately after the allowed replacement operation count is reached. Therefore, the user is given sufficient time to purchase a new collecting unit 121 and a new supply unit 122 before the developer must be replaced next time.

Figure 14:
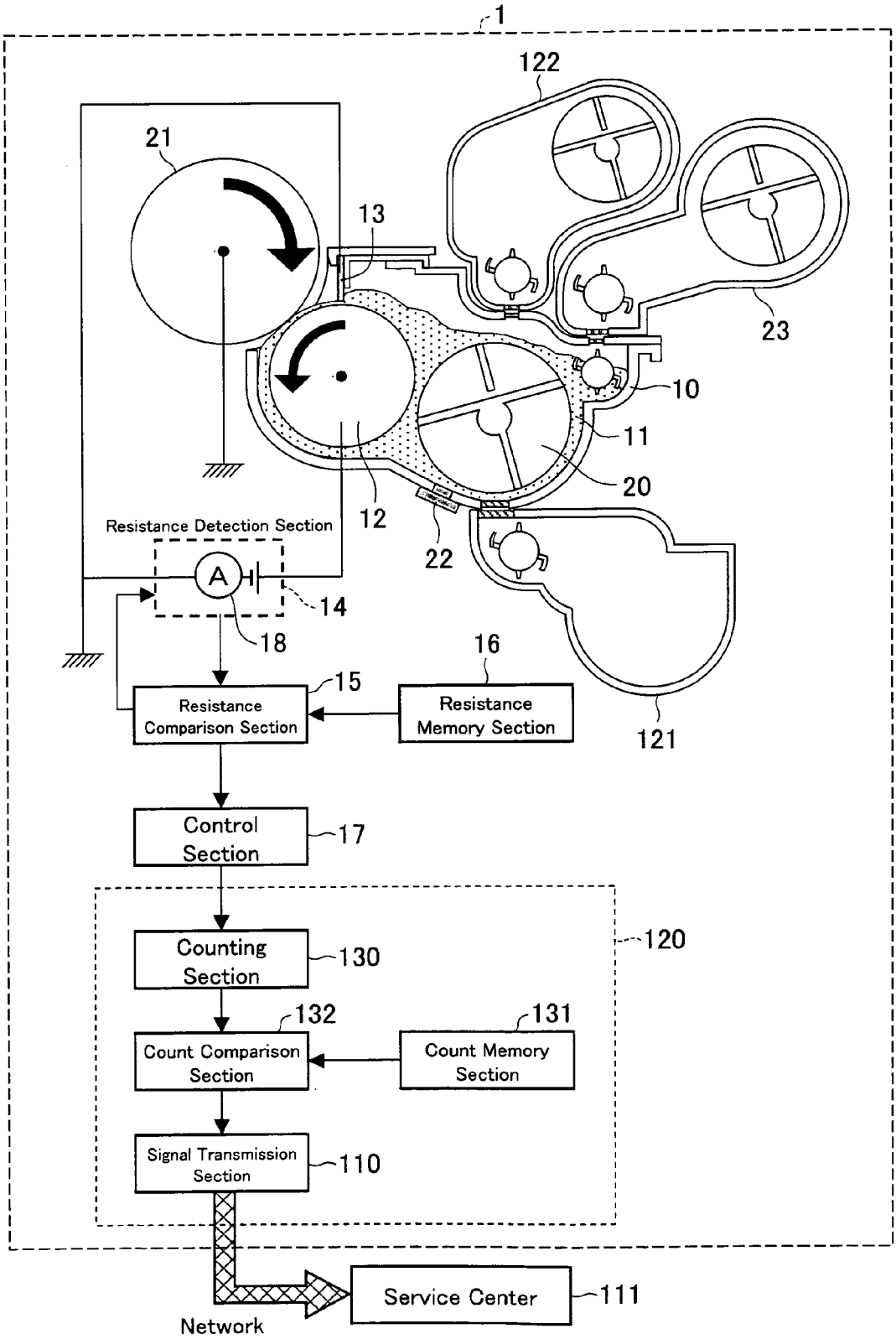
FIG. 14 A schematic of a structure of the image forming apparatus which after the developer replacing means is activated a predetermined number of times, transmits to a service center a signal prompting replacement of the collecting unit and the supply unit.

More preferably, as illustrated in FIG. 14, the image forming apparatus 1 includes a signal transmission section 110 transmitting signals over a network to a service center 111 which supports maintenance of the image forming apparatus 1, and the developer replacing section 120 includes a counting section 130 counting replacement operations, a count memory section 131 storing the allowed replacement operation count, and a count comparison section 132 comparing the replacement operation count provided by the counting section 130 with the allowed replacement operation count stored in the count memory section 131, wherein when the replacement operation count reaches the allowed replacement operation count, the signal transmission section 110 transmits to the service center 111 a signal indicative of a message that the collecting unit 121 and the supply unit 122 need to be replaced. Accordingly, the service center 111 can immediately recognize that the collecting unit 121 and the supply unit 122 need to be replaced and has a replacement operation immediately performed by a service person.

Figure 15:
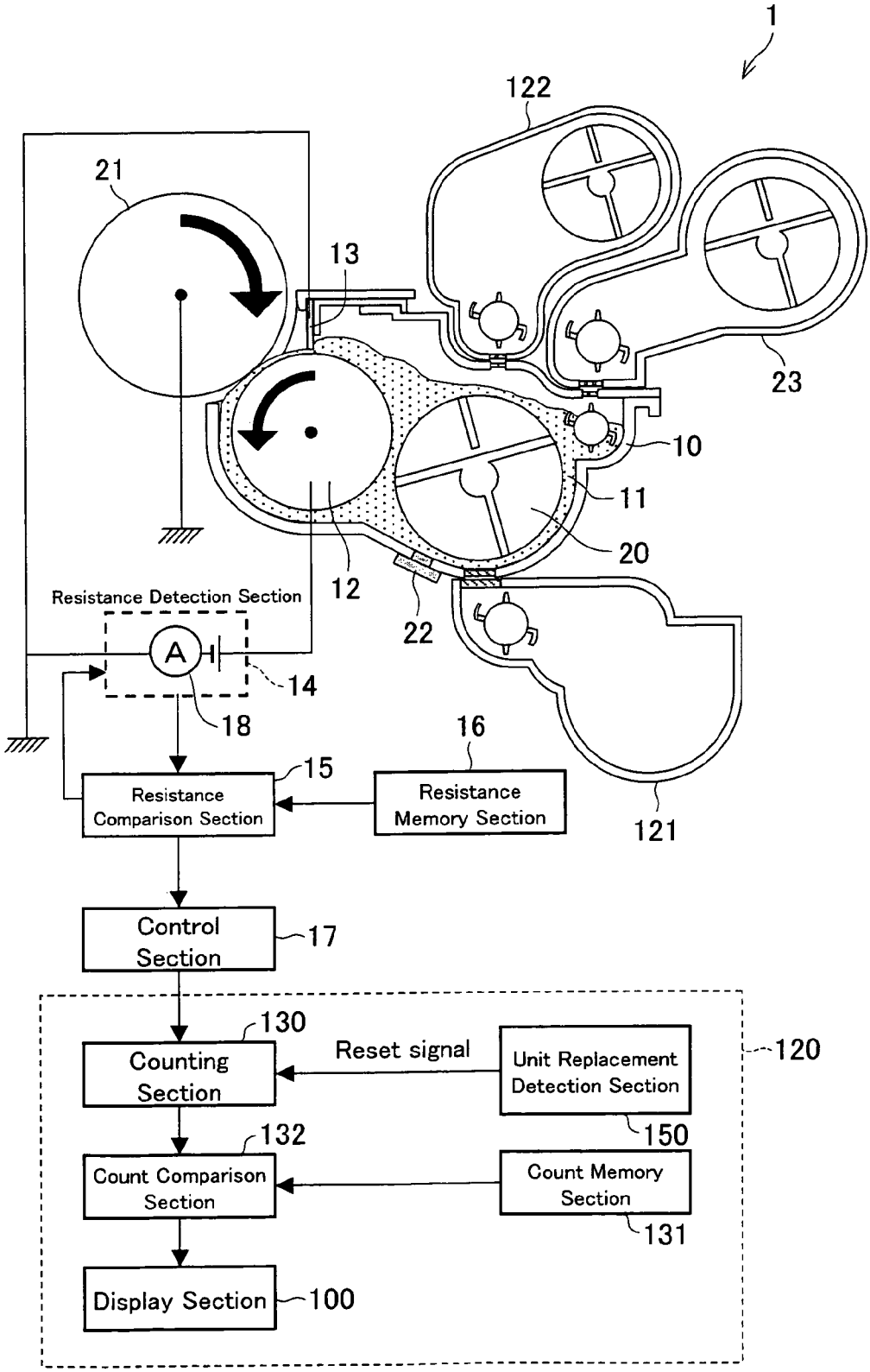
FIG. 15 A schematic of a structure of the image forming apparatus which has a function to reset a developer replacement operation count after the collecting unit and the supply unit are replaced.

The developer replacing section 120, as illustrated in FIG. 15, preferably includes a unit replacement detection section (unit replacement detection means) 150 detecting replacement of the collecting unit 121 and the supply unit 122, wherein when the unit replacement detection section 150 has detected replacement of the collecting unit 121 and the supply unit 122, the section 150 transmits a replacement operation count reset signal to the counting section 130 to reset the replacement operation count stored in the count memory section 131. Accordingly, the replacement operation count is automatically reset. The arrangement reliably performs the resetting when compared with the user manually resetting the count after the replacement. The arrangement thus prevents an error in the resetting operation and always maintains the device in normal operation.

In the present embodiment, the image forming apparatus 1 includes the display section 100 so that the display section 100 can display a message prompting replacement of the development unit 10, the collecting unit 121, and the supply unit 122 or display a turned-on alert lamp prompting replacement of the development unit 10. Alternatives are also possible. For example, the display section 100 may be provided in an external device or an external display device may be used.

The image forming apparatus according to the present embodiment may be an image forming apparatus, including a development unit having (i) a developer bearing member, internally having magnetic field generation means, which is provided with a rotatable non-magnetic and conductive sleeve and which carries on its surface a developer containing carrier and toner; and (ii) a developer regulation member for regulating an amount of the developer on the developer bearing member, said development unit supplying only the toner to the image bearing member so as to form a visible image, said image forming apparatus comprising: resistance detection means for measuring a volume resistivity of the developer stored in the development unit; and a replacement determination section for storing therein a preset volume resistivity and comparing the volume resistivity of the developer which has been measured by the resistance detection means with the preset volume resistivity so as to determine whether it is necessary or not to replace the developer, wherein the image forming apparatus includes a control section for carrying out a predetermined development unit replacement flow or a developer replacement flow if the replacement determination section determines that the volume resistivity of the developer which has been measured by the resistance detection section is lower than the preset volume resistivity.

Further, the image forming apparatus may be arranged so that: the resistance detection means includes a current measurement means provided between the developer bearing member and an opposite electrode so as to measure a current I flowing via the developer, and a resistance value R is calculated in accordance with an equation $R=V/I$ where V represents an electrical potential difference $V=|Vd-Vo|$ between an electrical potential Vd of the developer bearing member and an electrical potential Vo of the opposite electrode and I represents the current I, and a volume resistivity ρ is calculated in accordance with an equation $\rho=R\cdot S/d$ where S represents a contact area between the developer on the surface of the developer bearing member and the opposite electrode and "d" represents a gap between the developer bearing member and the opposite electrode.

Further, the image forming apparatus may be arranged so that the opposite electrode serves as the developer regulation member which is conductive.

Further, the image forming apparatus may be arranged so that: the opposite electrode is a rotatable conductive metal sleeve, and the conductive metal sleeve is provided with a cleaning blade for scraping off the carrier or the toner adhering to a surface of the conductive metal sleeve.

Further, the image forming apparatus may be arranged so that: the conductive metal sleeve is located, in a direction of rotation of the developer bearing member, downstream of the developer regulation member and upstream of a place where the developer bearing member faces the image bearing member.

Further, the image forming apparatus may be arranged so that: the electrical potential Vd of the developer bearing member and the electrical potential Vo of the opposite electrode have a relationship Vo>Vd if the toner is positively charged and has a relationship Vo<Vd if the toner is negatively charged.

Further, it may be so arranged that: the development unit further includes a toner concentration sensor used so that a toner concentration represented by a weight ratio of the toner relative to the developer is kept at a certain level, and the resistance detection section receives an output signal from the toner concentration sensor and operates only in case where a toner concentration obtained from the output signal reaches a predetermined value.

Further, it may be so arranged that: the preset resistivity is $\rho_1$ calculated in accordance with an equation $\rho_1=a\rho_0$ when $\rho_0=5.8\times10^{10}$ [Ω·cm], said equation expressing a relationship between $\rho_0$ and $\rho_1$, where $\rho_0$ represents a volume resistivity measured when an electrical potential difference between the developer bearing member and the conductive sleeve is 400 [V] in using the image bearing member as the conductive sleeve at a contact area between the image bearing member and the developer on the developer bearing member, $\rho_1$ represents a volume resisitivity of the developer which is measured by the resistance detection means, and "a" represents a proportionality constant.

Further, the image forming apparatus may be arranged so that: the display section is caused to display a message indicating that it is necessary to replace the development unit or outputs a command to turn on an alert lamp in the development unit replacement flow.

Further, the image forming apparatus may be arranged so as to further include a signal transmission function for transmitting via a network a signal to a service center, which supports maintenance work of the image forming apparatus, wherein the signal transmission function transmits, to the service center, an alert signal for prompting replacement of the development unit in the development unit replacement flow.

Further, the image forming apparatus may be arranged so as to further include developer replacement means, wherein the developer replacement means replaces the developer in the development unit replacement flow.

Further, the image forming apparatus may be arranged so as to further include: a collecting unit for collecting the developer from the development unit; and a supply unit for storing therein an unused developer and for supplying the unused developer to the development unit, wherein in the development unit replacement flow, the developer replacement means causes the collecting unit to collect a predetermined amount of the developer from the development unit and causes the supply unit to supply the same amount of a developer as the collected developer to the development unit.

Further, the image forming apparatus may be arranged so that the supply unit stores therein a developer so that an amount of the stored developer is an integral multiple of the predetermined amount of the developer collected and supplied in replacing the developer, and the collecting unit has a capacity which allows for storage of at least the developer stored in the supply unit.

Further, the image forming apparatus may be arranged so that: the developer replacement means includes: a counting section for counting replacement operations as a replacement operation count; a memory section for storing a preset number of times replacement can be made as an allowed replacement operation count; and a comparison section for comparing the replacement operation count provided by the counting section with the allowed replacement operation count stored in the memory section, and when the replacement operation count reaches the allowed replacement operation count, a display section of the image forming apparatus shows that it is necessary to replace the collecting unit and the supply unit.

Further, the image forming apparatus may be arranged so as to include a signal transmission function for transmitting a signal via a network to a service center for supporting maintenance work of the image forming apparatus, wherein the developer replacement means includes: a counting section for counting replacement operations as a replacement operation count; a memory section for storing a preset number of times replacement can be made as an allowed replacement operation count; and a comparison section for comparing the replacement operation count provided by the counting section with the allowed replacement operation count stored in the memory section, and the signal transmission function transmits, to the service center, a signal indicating that it is necessary to replace the collecting unit and the supply unit when the replacement operation count reaches the allowed replacement operation count.

Further, it may be so arranged that the developer replacement means further includes a unit replacement detection section for detecting replacement of the collecting unit and the supply unit, and the unit replacement detection section resets the replacement operation count stored in the counting section upon detecting the replacement of the collecting unit and the supply unit.

Lastly, blocks which are provided on the image forming apparatus according to the foregoing embodiment, particularly the resistance detection section 14, the resistance comparison section 15, the current measurement section 18, the toner concentration detection section 22, the signal transmission section 110, the developer replacement section 120, the counting section 130, the count comparison section 132, the unit replacement detection section 150, and blocks included therein are realized by hardware logic or may be realized by software using a CPU as follows.

That is, the image forming apparatus according to the foregoing embodiment includes: a CPU (central processing unit) which executes a control program realizing the functions; a ROM (read only memory) in which the program is stored; a RAM (random access memory) which develops the program; a storage device (storage medium) such as a memory in which the program and various kinds of data are stored; and the like. Further, the object of the technology can be achieved as follows: a storage medium for computer-readably storing a program code (an execute form program, intermediate code program, or source program) of the control program of the image forming apparatus which is software for implementing the aforementioned functions is provided to the image forming apparatus, and a computer (or CPU and MPU) reads out the program code stored in the storage medium so as to implement the program, thereby achieving the object of the technology.

Examples of the storage medium which satisfies these conditions include: tapes, such as magnetic tape and cassette tape; disks including magnetic disks, such as floppy disks (registered trademark) and hard disk, and optical disks, such as CD-ROMs, magnetic optical disks (MOs), mini disks (MDs), digital video disks (DVDs), and CD-Rs; cards, such as IC card (including memory cards) and optical cards; and semiconductor memories, such as mask ROMs, EPROMs, EEPROMs, and flash ROMs.

Further, the image forming apparatus may be arranged so that: the image forming apparatus is made connectable to communication networks, and the program code is supplied via the communication networks. The communication networks are not limited to a specific means. Specific examples of the communication network include Internet, intranet, extranet, LAN, ISDN, VAN, a CATV communication network, a virtual private network, a telephone line network, a mobile communication network, a satellite communication network, and the like. Further, a transmission medium constituting the communication network is not particularly limited. Specifically, it is possible to use a wired line such as a line in compliance with IEEE1394 standard, a USB line, a power line, a cable TV line, a telephone line, an ADSL line, and the like, as the transmission medium. Further, it is possible to use (i) a wireless line utilizing an infrared ray used in IrDA and a remote controller, (ii) a wireless line which is in compliance with Bluetooth standard (registered trademark) or IEEE802.11 wireless standard, and (iii) a wireless line utilizing HDR, a mobile phone network, a satellite line, a ground wave digital network, and the like, as the transmission medium. Note that, the technology can be realized by a computer data signal which is realized by electronic transmission of the program code and which is embedded in a carrier wave.

As described above, it is preferable to arrange the image forming apparatus so that: the resistance detection means includes a current measurement means between the developer bearing member and an opposite electrode so as to measure a current I flowing in the developer, and a resistance value R is calculated in accordance with an equation $R=V/I$ where V represents an electrical potential difference $V=|Vd-Vo|$ between an electrical potential Vd of the developer bearing member and an electrical potential Vo of the opposite electrode and I represents the current I flowing in the developer, and a volume resistivity $\rho[\Omega\cdot cm]$ is calculated in accordance with an equation $\rho=R\cdot S/d$ where S $[cm^2]$ represents a contact area between the developer on the surface of the developer bearing member and the opposite electrode and "d" [cm] represents a gap between the developer bearing member and the opposite electrode.

This makes it possible to measure the volume resistivity of the developer.

Further, it is preferable to arrange the image forming apparatus so that the opposite electrode serves as the developer regulation member which is conductive.

According to the arrangement, the developer regulation member serves as the opposite electrode, so that it is not necessary to newly provide any electrode member. In this manner, the volume resistivity of the developer can be measured with a simple arrangement, so that it is possible to reduce the cost of the image forming apparatus.

Further, it is preferable to arrange the image forming apparatus so that: the opposite electrode is a rotatable conductive metal sleeve, and the conductive metal sleeve is provided with a cleaning blade for scraping off the carrier or the toner adhering to a surface of the conductive metal sleeve.

According to the arrangement, the conductive metal sleeve serves as the opposite electrode. Further, the conductive metal sleeve is provided with the cleaning blade for scraping off the carrier or the toner adhering to the surface of the conductive metal sleeve, so that the contact face between the developer on the developer bearing member and the conductive metal sleeve can be always kept clean. Thus, it is possible to stably and highly reliably measure the volume resistivity of the developer.

Further, it is preferable to arrange the image forming apparatus so that the conductive metal sleeve is located, in a direction of rotation of the developer bearing member, downstream of the developer regulation member and upstream of a place where the developer bearing member faces the image bearing member.

According to the arrangement, the conductive metal sleeve is located downstream of the developer regulation member with respect to the direction of rotation of the developer bearing member, so that an amount of the developer led to the conductive metal sleeve is regulated to a certain amount by the developer regulation member. Thus, it is possible to stably measure the volume resistivity.

Further, the conductive metal sleeve is located upstream of the place where the developer bearing member faces the image bearing member. In case where the conductive metal sleeve is located downstream of the place where the developer bearing member faces the image bearing member, the amount of the developer led to the conductive metal sleeve varies at the time of the development process since the toner is consumed by the development process. Thus, the volume resistivity of the developer varies, so that it is impossible to calculate an exact volume resistivity of the developer. Thus, by locating the conductive metal sleeve upstream of the place where the developer bearing member faces the image bearing member, it is possible to exactly calculate the volume resistivity.

Further, it is preferable to arrange the image forming apparatus so that the electrical potential Vd of the developer bearing member and the electrical potential Vo of the opposite electrode are in a relationship $Vo>Vd$ if the toner is positively charged and are in a relationship $Vo<Vd$ if the toner is negatively charged.

According to the arrangement, the toner does not move from the image bearing member to the opposite electrode, so that it is possible to stably supply the toner to the image bearing member, thereby forming a high quality image.

Further, it is preferable to arrange the image forming apparatus so that: the development unit further includes toner concentration detection means for measuring a toner concentration represented by a weight ratio of the toner relative to the developer, and the resistance detection means measures the volume resistivity if the toner concentration measured by the toner concentration detection means is equal to or greater than a predetermined toner concentration.

According to the arrangement, the resistance detection means measures the volume resistivity of the developer if the toner concentration measured by the toner concentration detection means is equal to or greater than a predetermined toner concentration.

A dynamic resistance value of the developer varies depending on the toner concentration. Thus, in case where the volume resistivity of the developer is measured under such condition that the toner concentration is lower than the predetermined toner concentration, the measured value is smaller than the volume resistivity which should be measured. Further, in case where the measured volume resistivity is below the predetermined volume resistivity, the process for replacing the developer or the carrier is carried out. In this manner, the decrease of the toner concentration causes an apparent volume resistivity to decrease, which results in such malfunction that the process for replacing the developer or the carrier is carried out.

In contrast, the foregoing arrangement makes it possible to prevent the process for replacing the developer or the carrier from being carried out on the basis of the apparent volume resistivity.

Further, it is preferable to arrange the image forming apparatus so that the preset resistivity is $\rho_1$ calculated in accordance with an equation $\rho 1 = a\rho_0$ when $\rho_0 = 5.8\times10^{10}$ [Ωcm], said equation expressing a relationship between $\rho_0$ and $\rho_1$, where $\rho_0$ represents a volume resistivity measured when an electrical potential difference between the developer bearing member and the conductive sleeve is 400 [V] in using the image bearing member as the conductive sleeve at a contact area between the image bearing member and the developer on the developer bearing member, $\rho_1$ represents a volume resisitivity of the developer which is measured by the resistance detection means, and "a" represents a proportionality constant.

This arrangement makes it possible to reduce adhesion of the carrier onto the image bearing member, so that it is possible to form a high quality image which is free from any white spot or image overlapping.

Further, it is preferable to arrange the image forming apparatus so that the control means outputs a signal indicating that it is necessary to replace the development unit or outputs a command to turn on an alert lamp.

According to the arrangement, the signal indicating that it is necessary to replace the development unit or the command to turn on an alert lamp is outputted. This makes it possible for the user to immediately recognize that the developer deteriorates and it is necessary to replace the development unit, so that the development unit can be replaced rapidly, thereby keeping on forming high quality images. Further, this arrangement does not require service person's maintenance work, so that it is possible to reduce the running cost.

Note that, a specific example of the arrangement in which a signal indicating that it is necessary to replace the development unit is outputted is as follows. A signal causing a message for prompting replacement of the development unit to be displayed is outputted to a display section provided on the image forming apparatus or an external device.

Further, it is preferable to arrange the image forming apparatus so as to further include signal transmission means for transmitting via a network a signal for prompting replacement of the development unit to a service center, which supports maintenance work of the image forming apparatus, in accordance with a control signal from the control means, wherein the signal transmission means transmits, to the service center, a signal for prompting replacement of the development unit.

According to the arrangement, a signal for prompting replacement of the development unit is transmitted to the service center. This makes it possible for the service center to immediately recognize that replacement of the development unit is required. As a result, the service person can immediately carry out the replacement.

Further, it is preferable to arrange the image forming apparatus so as to further include developer replacement means for carrying out a process for replacing the developer in accordance with a control signal from the control means.

According to the arrangement, the developer is replaced by the developer replacement means. As a result, in case where the volume resistivity of the developer is lower than the preset volume resistivity, the image forming apparatus automatically replaces the developer, so that it is possible to reduce replacement operations carried out by the user or the service person. Further, the developer can be replaced without replacing the development unit, so that it is possible to reduce the maintenance cost.

Further, it is preferable to arrange the image forming apparatus so as to further include: a collecting unit for collecting the developer from the development unit; and a supply unit for storing therein an unused developer and for supplying the unused developer to the development unit, wherein the developer replacement means causes the collecting unit to collect a predetermined amount of the developer from the development unit and causes the supply unit to supply the same amount of a developer as the collected developer to the development unit.

According to the arrangement, the collecting unit collects a predetermined amount of the developer from the development unit and then the supply unit supplies the same amount of a developer as the collected developer to the development unit. As a result, the same amount of unused developer as the collected developer is supplied, so that the amount of the developer stored in the development unit is always constant in substance. This makes a stirring stress in the development unit constant. Thus, it is possible to stabilize charging of the toner and it is possible to form a magnetic brush which is uniform on the surface of the developer bearing member, so that formation of high quality images can be kept.

Further, it is preferable to arrange the image forming apparatus so that: the supply unit stores therein a developer so that an amount of the stored developer is an integral multiple of the predetermined amount of the developer collected and supplied in replacing the developer, and the collecting unit has a capacity which allows for storage of at least the developer stored in the supply unit.

As a result, an amount of an unused developer remaining in the supply unit is substantially zero in finishing a predetermined number of replacement operations, so that it is possible to suppress unnecessary consumption of the developer, thereby reducing the cost. Further, the collecting unit has only to have a minimum capacity for collecting the developer therein, so that it is not necessary to excessively enlarge the collecting unit, thereby reducing the material cost of the unit and the size of the image forming apparatus. Further, the collecting unit can store therein the same amount of the developer as the developer stored in the supply unit, so that a timing for replacing the unit is the same as replacement of the developer, thereby reducing operations.

Further, it is preferable to arrange the image forming apparatus so that the developer replacement means includes: counting means for counting replacement operations as a replacement operation count; a count memory section for storing a preset number of times replacement can be made as an allowed replacement operation count; and count comparison means for comparing the replacement operation count provided by the counting means with the allowed replacement operation count stored in the count memory section, and when the replacement operation count reaches the allowed replacement operation count, a signal indicating that it is necessary to replace the collecting unit and the supply unit is outputted or a command to turn on an alert lamp is outputted.

According to the arrangement, when the replacement operation count reaches the allowed replacement operation count, a signal indicating that it is necessary to replace the collecting unit and the supply unit is outputted or a command to turn on an alert lamp is outputted. This makes it possible to recognize a timing for replacing the supply unit and the collecting unit with a simple arrangement, so that it is possible to support the user for a rapid replacement operation. Further, replacement of the collecting unit and the supply unit is prompted right after the last replacement of the developer in the allowed replacement operation count. Thus, it is possible to give a sufficient time period for preparing a collecting unit and a supply unit by the time for the next replacement of the developer.

Note that, a specific example of an arrangement for outputting the signal indicating that it is necessary to replace the collecting unit and the supply unit is an arrangement for outputting a signal which causes a display section provided on the image forming apparatus or an external device to display a message for prompting replacement of the collecting unit and the supply unit.

Further, it is preferable to arrange the image forming apparatus so that the developer replacement means includes: counting means for counting replacement operations as a replacement operation count; a count memory section for storing a preset number of times replacement can be made as an allowed replacement operation count; count comparison means for comparing the replacement operation count provided by the counting means with the allowed replacement operation count stored in the count memory section; and signal transmission means for transmitting a signal via a network to a service center for supporting maintenance work of the image forming apparatus, and the signal transmission means transmits a signal indicating that it is necessary to replace the collecting unit and the supply unit to the service center when the replacement operation count reaches the allowed replacement operation count.

According to the arrangement, the signal transmission means transmits a signal indicating that it is necessary to replace the collecting unit and the supply unit to the service center when the replacement operation count reaches the allowed replacement operation count. This makes it possible for the service center to immediately recognize that it is necessary to replace the supply unit and the collecting unit. As a result, the service person can rapidly carry out the replacement operation.

Further, it is preferable to arrange the image forming apparatus so that: the developer replacement means further includes unit replacement detection means for detecting replacement of the collecting unit and the supply unit, and the unit replacement detection means transmits, to the counting means, a signal for resetting the replacement operation count upon detecting the replacement of the collecting unit and the supply unit.

According to the arrangement, the replacement operation count obtained by the counting means is reset when the unit replacement detection means detects the replacement of the collecting unit and the supply unit. This makes it possible to automatically reset the replacement operation count stored in the counting means, so that it is possible to more surely reset the replacement operation count than in case of manually resetting the replacement operation count after the replacement. As a result, it is possible to prevent inexact resetting, thereby always keeping a normal condition.

The technology being thus described, it will be obvious that the same way may be varied in many ways. Such variations are not to be regarded as a departure from the spirit and scope of the technology, and all such modifications as would be obvious to one skilled in the art are intended to be included within the scope of the following claims.

INDUSTRIAL APPLICABILITY

The image forming apparatus is widely applicable to a laser printer, a copying machine, a multi-functional printer, and the like, adopting an electrophotography-based image forming system which uses a two component developer containing carrier.

The invention claimed is:

1. An image forming apparatus, including a development unit having (i) a developer bearing member, internally having a magnetic field generation means, which is provided with a rotatable non-magnetic and conductive sleeve and which carries on its surface a developer containing carrier and toner; and (ii) a developer regulation member for regulating an amount of the developer supplied from the developer bearing member to an image bearing member, said image forming apparatus visualizing an electrostatic latent image formed on a surface of the image bearing member with the developer supplied from the development unit to the image bearing member, said image forming apparatus comprising:

a resistance detection means for measuring a volume resistivity of the developer on the surface of the developer bearing member;

a resistance memory section for storing therein a preset volume resistivity;

a resistance comparison means for comparing the volume resistivity of the developer which has been measured by the resistance detection means with the preset volume resistivity stored in the resistance memory section; and a control means for carrying out a process for replacing the developer or the carrier if the volume resistivity of the developer is lower than the preset volume resistivity.

2. The image forming apparatus as set forth in claim 1, wherein:

the resistance detection means includes a current measurement means between the developer bearing member and an opposite electrode so as to measure a current I flowing in the developer, and a resistance value R is calculated in accordance with an equation $R=V/I$ where V represents an electrical potential difference $V=|Vd-Vo|$ between an electrical potential Vd of the developer bearing member and an electrical potential Vo of the opposite electrode and I represents the current I flowing in the developer, and a volume resistivity $\rho[\Omega\cdot cm]$ is calculated in accordance with an equation $\rho=R\cdot S/d$ where S $[cm^2]$ represents a contact area between the developer on the surface of the developer bearing member and the opposite electrode and "d" [cm] represents a gap between the developer bearing member and the opposite electrode.

3. The image forming apparatus as set forth in claim 2, wherein the opposite electrode serves as the developer regulation member which is conductive.

4. The image forming apparatus as set forth in claim 2, wherein:

the opposite electrode is a rotatable conductive metal sleeve, and the conductive metal sleeve is provided with a cleaning blade for scraping off the carrier or the toner adhering to a surface of the conductive metal sleeve.

5. The image forming apparatus as set forth in claim 4, wherein the conductive metal sleeve is located, in a direction of rotation of the developer bearing member, downstream of the developer regulation member and upstream of a place where the developer bearing member faces the image bearing member.

6. The image forming apparatus as set forth in claim 2, wherein the electrical potential Vd of the developer bearing member and the electrical potential Vo of the opposite electrode are in a relationship Vo>Vd if the toner is positively charged and are in a relationship Vo<Vd if the toner is negatively charged.

7. The image forming apparatus as set forth in claim 1, wherein:

the development unit further includes a toner concentration detection means for measuring a toner concentration represented by a weight ratio of the toner relative to the developer, and the resistance detection means measures the volume resistivity if the toner concentration measured by the toner concentration detection means is equal to or greater than a predetermined toner concentration.

8. The image forming apparatus as set forth in claim 1, wherein the preset volume resistivity is $\rho_1$ calculated in accordance with an equation $\rho_1=a\rho_0$ when $\rho_0=5.8\times10^{10}$ [Ω·cm], said equation expressing a relationship between $\rho_0$ and $\rho_1$, where $\rho_0$ represents a volume resistivity measured when an electrical potential difference between the developer bearing member and the conductive sleeve is 400 [V] in using the image bearing member as the conductive sleeve at a contact area between the image bearing member and the developer on the developer bearing member, $\rho_1$ represents a volume resistivity of the developer which is measured by the resistance detection means, and "a" represents a proportionality constant.

9. The image forming apparatus as set forth in claim 1, wherein the control means outputs a signal indicating that it is necessary to replace the development unit or outputs a command to turn on an alert lamp.

10. The image forming apparatus as set forth in claim 1, further comprising a signal transmission means for transmitting via a network a signal for prompting replacement of the development unit to a service center, which supports maintenance work of the image forming apparatus, in accordance with a control signal from the control means, wherein the signal transmission means transmits, to the service center, a signal for prompting replacement of the development unit.

11. The image forming apparatus as set forth in claim 1, further comprising a developer replacement means for carrying out a process for replacing the developer in accordance with a control signal from the control means.

12. The image forming apparatus as set forth in claim 11, further comprising:

a collecting unit for collecting the developer from the development unit; and a supply unit for storing therein an unused developer and for supplying the unused developer to the development unit, wherein the developer replacement means causes the collecting unit to collect a predetermined amount of the developer from the development unit and causes the supply unit to supply the same amount of a developer as the collected developer to the development unit.

13. The image forming apparatus as set forth in 12, wherein:

the supply unit stores therein a developer so that an amount of the stored developer is an integral multiple of the predetermined amount of the developer collected and supplied in replacing the developer, and the collecting unit has a capacity which allows for storage of at least the developer stored in the supply unit.

14. The image forming apparatus as set forth in claim 13, wherein the developer replacement means includes:

a counting means for counting replacement operations as a replacement operation count;

a count memory section for storing a preset number of times replacement can be made as an allowed replacement operation count; and a count comparison means for comparing the replacement operation count provided by the counting means with the allowed replacement operation count stored in the count memory section, and when the replacement operation count reaches the allowed replacement operation count, a signal indicating that it is necessary to replace the collecting unit and the supply unit is outputted or a command to turn on an alert lamp is outputted.

15. The image forming apparatus as set forth in claim 14, wherein:

the developer replacement means further includes a unit replacement detection means for detecting replacement of the collecting unit and the supply unit, and the unit replacement detection means transmits, to the counting means, a signal for resetting the replacement operation count upon detecting the replacement of the collecting unit and the supply unit.

16. The image forming apparatus as set forth in claim 13, wherein the developer replacement means includes:

a counting means for counting replacement operations as a replacement operation count;

a count memory section for storing a preset number of times replacement can be made as an allowed replacement operation count; a count comparison means for comparing the replacement operation count provided by the counting means with the allowed replacement operation count stored in the count memory section; and a signal transmission means for transmitting a signal via a network to a service center for supporting maintenance work of the image forming apparatus, and the signal transmission means transmits a signal indicating that it is necessary to replace the collecting unit and the supply unit to the service center when the replacement operation count reaches the allowed replacement operation count.

17. The image forming apparatus as set forth in claim 16, wherein:

the developer replacement means further includes a unit replacement detection means for detecting replacement of the collecting unit and the supply unit, and the unit replacement detection means transmits, to the counting means, a signal for resetting the replacement operation count upon detecting the replacement of the collecting unit and the supply unit.

18. The image forming apparatus as set forth in claim 12, wherein the developer replacement means includes:

a counting means for counting replacement operations as a replacement operation count;

a count memory section for storing a preset number of times replacement can be made as an allowed replacement operation count; and a count comparison means for comparing the replacement operation count provided by the counting means with the allowed replacement operation count stored in the count memory section, and when the replacement operation count reaches the allowed replacement operation count, a signal indicating that it is necessary to replace the collecting unit and the supply unit is outputted or a command to turn on an alert lamp is outputted.

19. The image forming apparatus as set forth in claim 18, wherein:

the developer replacement means further includes a unit replacement detection means for detecting replacement of the collecting unit and the supply unit, and the unit replacement detection means transmits, to the counting means, a signal for resetting the replacement operation count upon detecting the replacement of the collecting unit and the supply unit.

20. The image forming apparatus as set forth in claim 12, wherein the developer replacement means includes:

a counting means for counting replacement operations as a replacement operation count;

a count memory section for storing a preset number of times replacement can be made as an allowed replacement operation count;

a count comparison means for comparing the replacement operation count provided by the counting means with the allowed replacement operation count stored in the count memory section; and a signal transmission means for transmitting a signal via a network to a service center for supporting maintenance work of the image forming apparatus, and the signal transmission means transmits a signal indicating that it is necessary to replace the collecting unit and the supply unit to the service center when the replacement operation count reaches the allowed replacement operation count.

21. The image forming apparatus as set forth in claim 20, wherein:

the developer replacement means further includes a unit replacement detection means for detecting replacement of the collecting unit and the supply unit, and the unit replacement detection means transmits, to the counting means, a signal for resetting the replacement operation count upon detecting the replacement of the collecting unit and the supply unit.

22. An image forming computer program stored on a computer readable medium, the computer program causing the image forming apparatus as set forth in claim 1, to operate, wherein the image forming computer program causes a computer to function as the resistance detection means, resistance comparison means and the control means.

23. An image forming method, in which a developer containing carrier and toner is attached to a surface of a developer bearing member internally having a magnetic field generation means and provided with a rotatable non-magnetic and conductive sleeve, and an amount of the developer supplied from the developer bearing member to an image bearing member is regulated by a developer regulation member, and an electrostatic latent image formed on a surface of the image bearing member is visualized with the developer, said image forming method comprising the steps of:

(i) measuring a volume resistivity of the developer on the surface of the developer bearing member;

(ii) storing a preset volume resistivity in a resistance memory section;

(iii) comparing the volume resistivity of the developer which has been measured in the step (i) with the preset volume resistivity stored in the resistance memory section; and (iv) carrying out a process for replacing the developer or the carrier if the volume resistivity of the developer is lower than the preset volume resistivity.

24. An image forming apparatus, including a development unit having (i) a developer bearing member, internally having a magnetic field generation means, which is provided with a rotatable non-magnetic and conductive sleeve and which carries on its surface a developer containing carrier and toner; and (ii) a developer regulation member for regulating an amount of the developer supplied from the developer bearing member to an image bearing member, said image forming apparatus visualizing an electrostatic latent image formed on a surface of the image bearing member with the developer supplied from the development unit to the image bearing member, the image forming apparatus comprising:

a resistance detector that measures a volume resistivity of the developer on the surface of the developer bearing member;

a resistance memory section for storing therein a preset volume resistivity;

a resistance comparison unit that compares the volume resistivity of the developer which has been measured by the resistance detector with the preset volume resistivity stored in the resistance memory section; and a controller that carries out a process for replacing the developer or the carrier if the volume resistivity of the developer is lower than the preset volume resistivity.

* * * * *